US008018422B2

(12) United States Patent
Morita

(10) Patent No.: US 8,018,422 B2
(45) Date of Patent: Sep. 13, 2011

(54) SOURCE DRIVER, ELECTRO-OPTICAL DEVICE, AND ELECTRONIC INSTRUMENT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 874 days.

(21) Appl. No.: 12/010,159

(22) Filed: Jan. 22, 2008

(65) Prior Publication Data

US 2009/0079767 A1 Mar. 26, 2009

(30) Foreign Application Priority Data

Jan. 22, 2007 (JP) ..... 2007-011222
Dec. 19, 2007 (JP) ..... 2007-327193

(51) Int. Cl.
*G09G 3/36* (2006.01)

(52) U.S. Cl. ..... 345/100; 345/89; 345/94; 345/204; 345/690

(58) Field of Classification Search ..... 345/76–80, 345/82, 83, 87, 88, 90, 92, 94, 95, 96, 98–100, 345/204–206, 208–210, 214, 215, 690
See application file for complete search history.

(56) References Cited

U.S. PATENT DOCUMENTS 5,296,847 A 3/1994 Takeda et al.
7,345,663 B2 * 3/2008 Kobayashi ..... 345/87
7,701,451 B1 * 4/2010 Daewon et al. ..... 345/204
7,817,123 B2 * 10/2010 Do et al. ..... 345/87
2004/0239603 A1 12/2004 Toriumi et al.
2005/0057231 A1 3/2005 Morita

FOREIGN PATENT DOCUMENTS

JP A-02-157815 6/1990
JP A-2004-272103 9/2004
JP A-2005-037834 2/2005

* cited by examiner

*Primary Examiner* — Lun-Yi Lao
*Assistant Examiner* — Tom Sheng
(74) *Attorney, Agent, or Firm* — Oliff & Berridge PLC

(57) ABSTRACT

A source driver supplies a grayscale voltage to a liquid crystal capacitor and a storage capacitor provided in parallel with the liquid crystal capacitor, a voltage that changes in synchronization with a polarity inversion timing being applied to one end of the storage capacitor. The source driver includes an offset value calculation section that calculates an offset value based on grayscale data corresponding to respective color components of one pixel, a grayscale data correction section that corrects the grayscale data using the offset value corresponding to the respective color components, and a source line driver section that drives a source line corresponding to the respective color components based on the grayscale data that has been corrected by the grayscale data correction section. The source line driver section drives the source line corresponding to the respective color components based on the grayscale data that has been corrected by the grayscale data correction section, and then drives the source lines corresponding to the respective color components based on the grayscale data before being corrected by the grayscale data correction section.

18 Claims, 25 Drawing Sheets

FIG. 13

| RSUM | Roffset |
|---|---|
| 0 0 0 0 | 0 0 0 0 |
| 0 0 0 1 | 0 0 0 0 |
| 0 0 1 0 | 0 0 0 0 |
| 0 0 1 1 | 0 0 0 0 |
| 0 1 0 0 | 0 0 0 1 |
| 0 1 0 1 | 0 0 0 1 |
| 0 1 1 0 | 0 0 1 0 |
| 0 1 1 1 | 0 0 1 0 |
| 1 0 0 0 | 0 0 1 1 |
| ⋮ | ⋮ |
| 1 1 0 0 | 0 1 0 1 |
| 1 1 0 1 | 0 1 0 1 |
| 1 1 1 0 | 0 1 1 0 |
| 1 1 1 1 | 0 1 1 1 |

FIG. 19A

| $RSUM_n$ | $GSUM_{n-1}$ | $BSUM_{n-1}$ | Roffset |
|---|---|---|---|
| 0 0 0 0 | 0 0 0 0 | 0 0 0 0 | 0 1 1 1 |
| ⋮ | ⋮ | ⋮ | ⋮ |

FIG. 19B

| $GSUM_n$ | $BSUM_{n-1}$ | Goffset |
|---|---|---|
| 0 0 0 0 | 0 0 0 0 | 0 1 1 1 |
| ⋮ | ⋮ | ⋮ |

FIG. 19C

| $BSUM_n$ | Boffset |
|---|---|
| 0 0 0 0 | 0 1 1 1 |
| ⋮ | ⋮ |

| $RSUM_p$ | $RSUM_{p-1}$ | Roffset |
|---|---|---|
| 0 0 0 0 | 0 0 0 0 | 0 0 0 0 |
| ⋮ | ⋮ | ⋮ |
| 0 1 0 0 | 0 1 0 0 | 0 0 0 1 |
| ⋮ | ⋮ | ⋮ |

SOURCE DRIVER, ELECTRO-OPTICAL DEVICE, AND ELECTRONIC INSTRUMENT

Japanese Patent Application No. 2007-11222 filed on Jan. 22, 2007 and Japanese Patent Application No. 2007-327193 filed on Dec. 19, 2007, are hereby incorporated by reference in their entirety.

BACKGROUND OF THE INVENTION

The present invention relates to a source driver, an electro-optical device, an electronic instrument, and the like.

An active matrix type liquid crystal display device includes a plurality of gate lines and a plurality of source lines formed in a matrix. The active matrix type liquid crystal display device also includes a plurality of switching elements, each of which is connected to the corresponding gate line and the corresponding source line, and a plurality of pixel electrodes, each of which is connected to the corresponding switching element. The pixel electrodes are opposite to a common electrode through a liquid crystal (electro-optical substance in a broad sense).

In the liquid crystal display device having such a configuration, a voltage supplied to the source line is applied to the pixel electrode via the switching element which has been turned ON through the selected gate line. The transmissivity of the pixel changes depending on the voltage applied between the pixel electrode and the common electrode.

In a liquid crystal display device, a liquid crystal must be AC-driven in order to prevent deterioration in the liquid crystal. Therefore, polarity inversion drive is performed in the liquid crystal display device in which the polarity of the voltage applied between the pixel electrode and the common electrode is reversed upon expiration of one frame or one or more horizontal scan periods. For example, polarity inversion drive is implemented by changing the voltage supplied to the common electrode in synchronization with the polarity inversion timing.

As technology which reduces the power consumption of a liquid crystal display device which performs polarity inversion drive, a capacitive coupling drive method and similar technology have been known. According to the capacitive coupling drive method, as disclosed in JP-A-2-157815, an image signal voltage is transmitted to a pixel electrode when a thin film transistor (switching element) is turned ON, for example. The potential of the pixel electrode is changed by applying a voltage of which the polarity is reversed when the thin film transistor is turned OFF so that the change in potential and the pixel signal voltage are superimposed on or offset with respect to each other to change the transmittance of the pixel. Power consumption is reduced by reducing the amplitude of the image signal voltage due to movement of a charge caused by the voltage of which the polarity is reversed.

In order to apply the voltage of which the polarity is reversed, it is necessary to provide a switch circuit which switches between the voltages provided in advance. In order to reduce power consumption necessary when controlling the liquid crystal display device, it is indispensable to reduce the impedance of the switch circuit. Therefore, it is necessary to increase the size of a transistor element which forms the switch circuit. However, when the screen size of the liquid crystal display device increases, it is difficult to increase the size of the transistor element which forms the switch circuit provided corresponding to each scan line, for example. Moreover, the image signal write time decreases as the screen size increases. In particular, the image signal write time becomes insufficient when performing multiplex drive. As a result, image quality deteriorates due to occurrence of crosstalk.

SUMMARY

Some aspects of the invention may provide a source driver which is suitable for capacitive coupling drive even if the screen size increases, an electro-optical device, and an electronic instrument.

According to one aspect of the invention, there is provided a source driver that supplies a grayscale voltage to a liquid crystal capacitor and a storage capacitor provided in parallel with the liquid crystal capacitor, a voltage that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section.

According to another aspect of the invention, there is provided a source driver that supplies a grayscale signal to an element capacitor and a storage capacitor provided in parallel with the element capacitor, a signal that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section.

According to another aspect of the invention, there is provided an electro-optical device comprising:

a plurality of gate lines;

a plurality of source lines;

a plurality of liquid crystal capacitors;

a plurality of storage capacitors;

a plurality of switching elements, when a switching element among the plurality of switching elements has been selected by a corresponding gate line among the plurality of gate lines, a voltage of a corresponding source line among the plurality of source lines being supplied to one end of a corresponding liquid crystal capacitor among the plurality of liquid crystal capacitors and one end of a corresponding storage capacitor among the plurality of storage capacitors;

a gate driver that scans the plurality of gate lines; and one of the above source drivers that drives the plurality of source lines, a high-potential-side voltage or a low-potential-side voltage being applied to the other end of the plurality of storage capacitors in synchronization with a polarity inversion timing.

According to another aspect of the invention, there is provided an electronic instrument comprising one of the above source drivers.

According to another aspect of the invention, there is provided an electronic instrument comprising the above electro-optical device.

BRIEF DESCRIPTION OF THE SEVERAL VIEWS OF THE DRAWING

FIG. 13 is a view illustrative of the operation of an offset value conversion section shown in FIG. 11.

FIGS. 19A, 19B, and 19C are views illustrative of the operation of an offset value conversion section.

DETAILED DESCRIPTION OF THE EMBODIMENT

Figure 1:
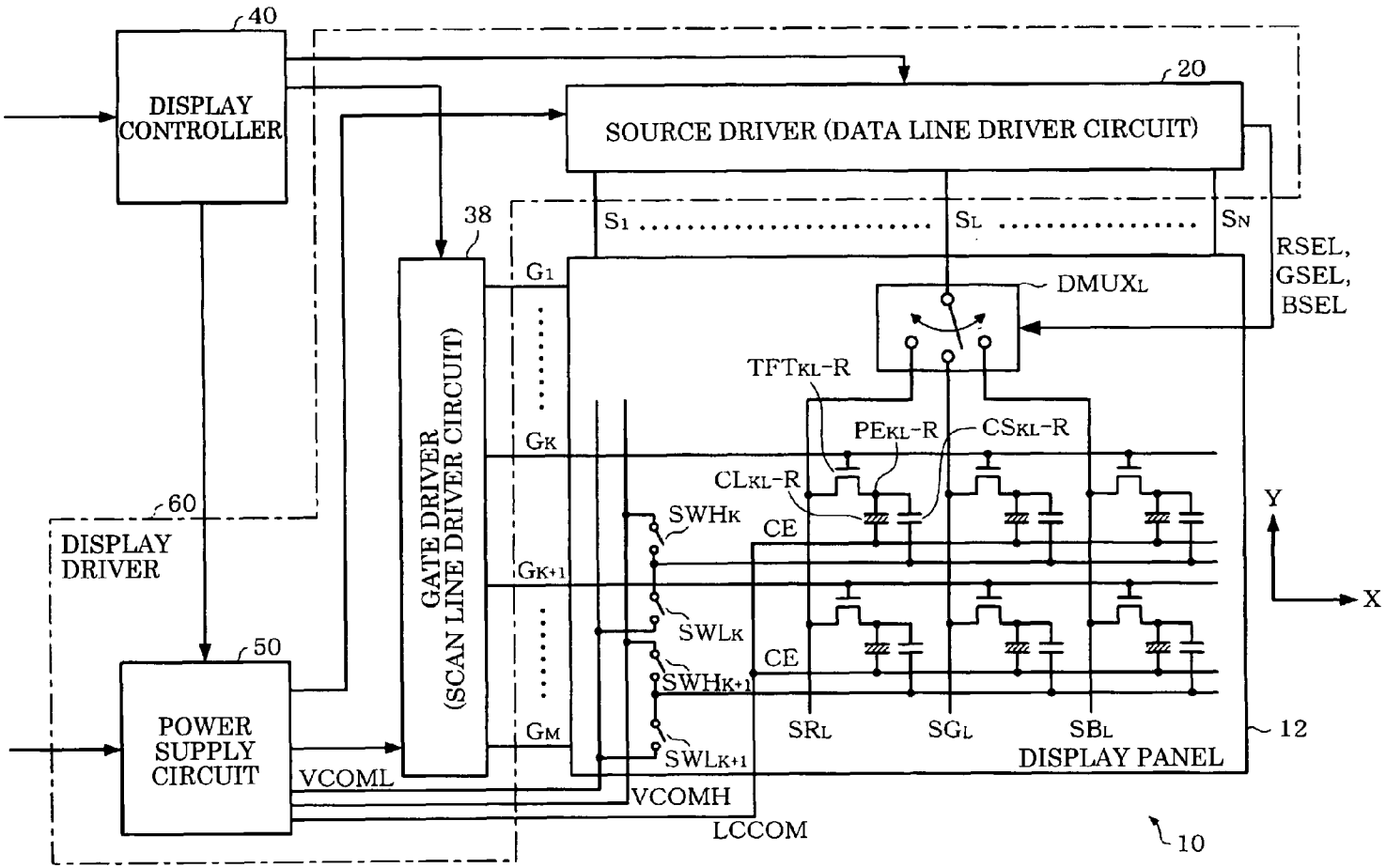
FIG. 1 is a block diagram showing a principle configuration example of a liquid crystal display device according to one embodiment of the invention.

According to one embodiment of the invention, there is provided a source driver that supplies a grayscale voltage to a liquid crystal capacitor and a storage capacitor provided in parallel with the liquid crystal capacitor, a voltage that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section.

When the grayscale voltage is supplied to the source line and a pixel electrode, the voltage of the other end of the storage capacitor capacitively coupled with the source line changes. According to this embodiment, the offset value is calculated based on the grayscale data, and the source line is driven based on the grayscale voltage corresponding to the data obtained by correcting the grayscale data using the offset value. Therefore, even if recovery of the original potential is delayed after a change caused by capacitive coupling due to the parasitic capacitor and the parasitic resistance at the other end of the storage capacitor, a change in the voltage at the other end of the storage capacitor can be suppressed by quickly stabilizing the source line. This prevents a situation in which the voltage applied to a liquid crystal becomes insufficient, whereby crosstalk can be prevented. Therefore, a source driver can be provided which is suitable for capacitive coupling drive even if the screen size increases.

In the source driver, the offset value calculation section may calculate the offset value corresponding to an amount of charge stored in a parasitic capacitor of the source line immediately before driving a present scan line.

According to this embodiment, the offset value corresponding to the amount of charge stored in the parasitic capacitor of the source line immediately before driving the present scan line is calculated, and the grayscale data is corrected using the offset value. Therefore, a change in the voltage at the other end of the storage capacitor can be more reliably suppressed.

In the source driver, the offset value calculation section may add up first-color-component grayscale data contained in grayscale data corresponding to one scan line to calculate first-color-component addition data, and may output an offset value corresponding to the first-color-component addition data.

According to this embodiment, an evaluation value for calculating an offset value can be obtained by a simple configuration.

In the source driver, when the source line driver section drives the source line by time division within one horizontal scan period in an order of a first color component, a second color component, and a third color component, the offset value calculation section may respectively add up first-color-component grayscale data, second-color-component grayscale data, and third-color-component grayscale data contained in grayscale data corresponding to one scan line to calculate first-color-component addition data, second-color-component addition data, and third-color-component addition data, and may calculate a first-color-component offset value based on at least the first-color-component addition data corresponding to a present scan line, the second-color-component addition data corresponding to a preceding scan line, and the second-color-component addition data corresponding to the preceding scan line;

the grayscale data correction section may correct the first-color-component grayscale data using the first-color-component offset value; and the source line driver section may drive the source line based on the first-color-component grayscale data that has been corrected by the grayscale data correction section.

In the source driver, the offset value calculation section may calculate a second-color-component offset value based on at least the second-color-component addition data corresponding to the present scan line and the third-color-component addition data corresponding to the preceding scan line;

the grayscale data correction section may correct the second-color-component grayscale data using the second-color-component offset value; and the source line driver section may drive the source line based on the second-color-component grayscale data that has been corrected by the grayscale data correction section.

In the source driver, the offset value calculation section may calculate a third-color-component offset value based on at least the third-color-component addition data corresponding to the present scan line;

the grayscale data correction section may correct the third-color-component grayscale data using the third-color-component offset value; and the source line driver section may drive the source line based on the third-color-component grayscale data that has been corrected by the grayscale data correction section.

According to one of the above embodiments, a change in the voltage at the other end of the storage capacitor can be more reliably suppressed even if the write time of the pixel electrode by multiplex drive is short.

In the source driver, the offset value calculation section may calculate the offset value corresponding to an amount of charge stored in a pixel electrode immediately before a present vertical scan period.

In the source driver, the offset value calculation section may add up first-color-component grayscale data contained in grayscale data corresponding to one scan line to calculate first-color-component addition data, and may output the offset value based on the first-color-component addition data corresponding to a present scan line in the present vertical scan period and the first-color-component addition data corresponding to the present scan line in a preceding vertical scan period.

According to one of the above embodiments, the offset value corresponding to the amount of charge stored in the pixel electrode immediately before the present vertical scan period is calculated, and the grayscale data is corrected using the offset value. Therefore, a change in the voltage at the other end of the storage capacitor can be more reliably suppressed.

In the source driver, the offset value calculation section may include a converted voltage value generation section that generates voltage value data corresponding to the grayscale data, the offset value calculation section may calculate the offset value corresponding to the respective color components of one pixel based on the voltage value data instead of the grayscale data.

According to this embodiment, since the voltage value data is output corresponding to the grayscale characteristics of the drive target electro-optical device, an error due to the offset value can be reduced when evaluating the addition result of the grayscale data to calculate the offset value.

In the source driver, the grayscale data correction section may correct the grayscale data by adding up the offset value and the grayscale data.

According to this embodiment, the grayscale data can be corrected using the offset value by a simple configuration.

In the source driver, the source driver may change a voltage level of at least one of a high-potential-side voltage and a low-potential-side voltage supplied to the one end of the storage capacitor in synchronization with the polarity inversion timing based on the offset value.

In the source driver, the source driver may change a voltage level of at least one of a high-potential-side voltage and a low-potential-side voltage supplied to the one end of the storage capacitor in synchronization with the polarity inversion timing in a period corresponding to the offset value.

According to one of the above embodiments, a change in the voltage level at the other end of the storage capacitor can be suppressed more reliably and quickly.

According to another embodiment of the invention, there is provided a source driver that supplies a grayscale signal to an element capacitor and a storage capacitor provided in parallel with the element capacitor, a signal that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section.

According to another embodiment of the invention, there is provided an electro-optical device comprising:

a plurality of gate lines;

a plurality of source lines;

a plurality of liquid crystal capacitors;

a plurality of storage capacitors;

a plurality of switching elements, when a switching element among the plurality of switching elements has been selected by a corresponding gate line among the plurality of gate lines, a voltage of a corresponding source line among the plurality of source lines being supplied to one end of a corresponding liquid crystal capacitor among the plurality of liquid crystal capacitors and one end of a corresponding storage capacitor among the plurality of storage capacitors;

a gate driver that scans the plurality of gate lines; and one of the above source drivers that drives the plurality of source lines, a high-potential-side voltage or a low-potential-side voltage being applied to the other end of the plurality of storage capacitors in synchronization with a polarity inversion timing.

According to this embodiment, an electro-optical device can be provided to which a source driver suitable for capacitive coupling drive even if the screen size increases is applied.

According to another embodiment of the invention, there is provided an electronic instrument comprising one of the above source drivers.

According to another embodiment of the invention, there is provided an electronic instrument comprising the above electro-optical device.

According to one of the above embodiments, an electronic instrument can be provided to which a source driver suitable for capacitive coupling drive even if the screen size increases is applied.

Embodiments of the invention are described in detail below with reference to the drawings. Note that the embodiments described below do not in any way limit the scope of the invention laid out in the claims. Note that all elements of the embodiments described below should not necessarily be taken as essential requirements for the invention.

1. Liquid Crystal Display Device

FIG. 1 is a block diagram showing a principle configuration example of a liquid crystal display device according to one embodiment of the invention.

A liquid crystal display device 10 (liquid crystal device; electro-optical device in a broad sense) includes a display panel 12 (liquid crystal panel or liquid crystal display (LCD) panel in a narrow sense; electro-optical panel in a broad sense), a source driver 20 (data line driver circuit in a broad sense), a gate driver 38 (scan line driver circuit in a broad sense), a display controller 40, and a power supply circuit 50. Note that the liquid crystal display device 10 need not necessarily include all of these circuit blocks. The liquid crystal display device 10 may have a configuration in which some of these circuit blocks are omitted. The term "electro-optical device" may include a device using a light-emitting element such as an organic electroluminescence (EL) element or an inorganic EL element.

The display panel 12 (electro-optical device) includes a plurality of gate lines (scan lines in a broad sense), a plurality of source lines (data lines in a broad sense), and pixel electrodes specified by the gate lines and the source lines. In this case, an active matrix type liquid crystal device may be formed by connecting a thin film transistor (TFT; switching element in a broad sense) to the source line and connecting the pixel electrode to the TFT.

Specifically, the display panel 12 is a liquid crystal panel formed on an active matrix substrate (e.g., glass substrate). Gate lines $G_1$ to $G_M$ (M is a natural number equal to or larger than two), arranged in a direction Y in FIG. 1 and extending in a direction X, and source lines $SR_1$, $SG_1$, $SB_1$, $SR_2$, $SG_2$, $SB_2$, . . . , $SR_N$, $SG_N$, and $SB_N$ (N is a natural number equal to or larger than two), arranged in the direction X and extending in the direction Y, are disposed on the active matrix substrate. Source voltage supply lines $S_1$ to $S_N$ are provided on the active matrix substrate. Demultiplexers are also provided on the active matrix substrate corresponding to the source voltage supply lines.

A thin film transistor $TFT_{KL}$-R (thin film transistor $TFT_{KL}$-G or $TFT_{KL}$-B) (switching element in a broad sense) is provided at a position corresponding to the intersection of the gate line $G_K$ ($1 \leqq K \leqq M$, K is a natural number) and the source line $SR_L$ (source line $SG_L$ or $SB_L$) ($1 \leqq L \leqq N$, L is a natural number).

For example, a gate electrode of the thin film transistor $TFT_{KL}$-R is connected to the gate line $G_K$, a source electrode of the thin film transistor $TFT_{KL}$-R is connected to the source line $SR_L$, and a drain electrode of the thin film transistor $TFT_{KL}$-R is connected to a pixel electrode $PE_{KL}$-R. A liquid crystal capacitor $CL_{KL}$-R (liquid crystal element) as an element capacitor is formed between the pixel electrode $PE_{KL}$-R and a common electrode CE opposite to the pixel electrode $PE_{KL}$-R through a liquid crystal (electro-optical substance in a broad sense). The liquid crystal is sealed between the active matrix substrate provided with the thin film transistor $TFT_{KL}$-R, the pixel electrode $PE_{KL}$-R, and the like and a common substrate provided with the common electrode CE. The transmissivity of the pixel changes depending on the voltage applied between the pixel electrode $PE_{KL}$-R and the common electrode CE. The term "element capacitor" may include a liquid crystal capacitor formed in a liquid crystal element and a capacitor formed in an EL element such as an inorganic EL element.

One end of a storage capacitor $CS_{KL}$-R (swing capacitor) is connected to the pixel electrode $PE_{KL}$-R. A high-potential-side voltage VCOMH or a low-potential-side voltage VCOML is supplied to the other end of the storage capacitor $CS_{KL}$-R. The high-potential-side voltage VCOMH and the low-potential-side voltage VCOML are generated by a polarity inversion voltage generation circuit included in the power supply circuit 50. The display panel 12 includes a switch circuit for selectively supplying the high-potential-side voltage VCOMH or the low-potential-side voltage VCOML (signal in a broad sense) to the other end of the storage capacitor $CS_{KL}$-R corresponding to a polarity inversion timing, the switch circuit being provided corresponding to each scan line (e.g., corresponding to each gate line).

The switch circuit provided corresponding to each gate line has an identical configuration. For example, the switch circuit provided corresponding to the gate line $G_K$ includes switching elements $SWH_K$ and $SWL_K$. The high-potential-side voltage VCOMH is supplied to one end of the switching element $SWH_K$. The other end of the switching element $SWH_K$ is electrically connected to the other end of each storage capacitor provided in parallel with each pixel electrode which can be selected by the gate line $G_K$. The low-potential-side voltage VCOML is supplied to one end of the switching element $SWL_K$. The other end of the switching element $SWL_K$ is electrically connected to the other end of each storage capacitor provided in parallel with each pixel electrode which can be selected by the gate line $G_K$.

A demultiplexer $DMUX_L$ separately supplies grayscale voltages supplied to the source voltage supply line $S_L$ by time division to the source lines $SR_L$, $SG_L$, and $SB_L$. The demultiplexer $DMUX_L$ separately supplies the grayscale voltages supplied to the source voltage supply line $S_L$ to the source lines based on a multiplex control signal supplied from the source driver 20.

A given constant voltage LCCOM is supplied to the common electrode CE. The constant voltage LCCOM is generated by a constant voltage generation circuit included in the power supply circuit 50.

The source driver 20 drives the source voltage supply lines $S_1$ to $S_N$ of the display panel 12 based on grayscale data. Since the demultiplexers $DMUX_1$ to $DMUX_N$ separate the grayscale voltages when the source driver 20 drives the source voltage supply lines $S_1$ to $S_N$, the source driver 20 can drive the source lines $SR_1$, $SG_1$, $SB_1$, $SR_2$, $SG_2$, $SB_2$, . . . , $SR_N$, $SG_N$, and $SB_N$. The gate driver 38 scans (sequentially drives) the gate lines $G_1$ to $G_M$ of the display panel 12.

The display controller 40 controls the source driver 20, the gate driver 38, and the power supply circuit 50 based on information set by a host (not shown) such as a central processing unit (CPU). Specifically, the display controller 40 sets the operation mode of the source driver 20 and the gate driver 38 or supplies a vertical synchronization signal and a horizontal synchronization signal generated therein to the source driver 20 and the gate driver 38, and controls the power supply circuit 50 relating to the polarity inversion timing of the voltage level of the common electrode voltage VCOM, for example.

The power supply circuit 50 generates various voltage levels (grayscale voltages) necessary for driving the display panel 12 and the voltage levels of the constant voltage applied to the common electrode CE and the polarity inversion voltage VCOM (high-potential-side voltage VCOMH or low-potential-side voltage VCOML) based on a reference voltage supplied from the outside.

In the liquid crystal display device 10 having such a configuration, the source driver 20, the gate driver 38, and the power supply circuit 50 cooperate to drive the display panel 12 based on grayscale data supplied from the outside under control of the display controller 40.

FIG. 1 shows an example in which one pixel includes three dots for displaying the RGB color components and the source lines are provided corresponding to the respective color components. Note that one pixel may include two dots or four or more dots.

In FIG. 1, the liquid crystal display device 10 includes the display controller 40. Note that the display controller 40 may be provided outside the liquid crystal display device 10. Alternatively, the liquid crystal display device 10 may include the host together with the display controller 40. Some or all of the source driver 20, the gate driver 38, the display controller 40, and the power supply circuit 50 may be formed on the display panel 12.

In FIG. 1, a display driver 60 may be formed as a semiconductor device (integrated circuit (IC)) by integrating the source driver 20, the gate driver 38, and the power supply circuit 50.

Figure 2:
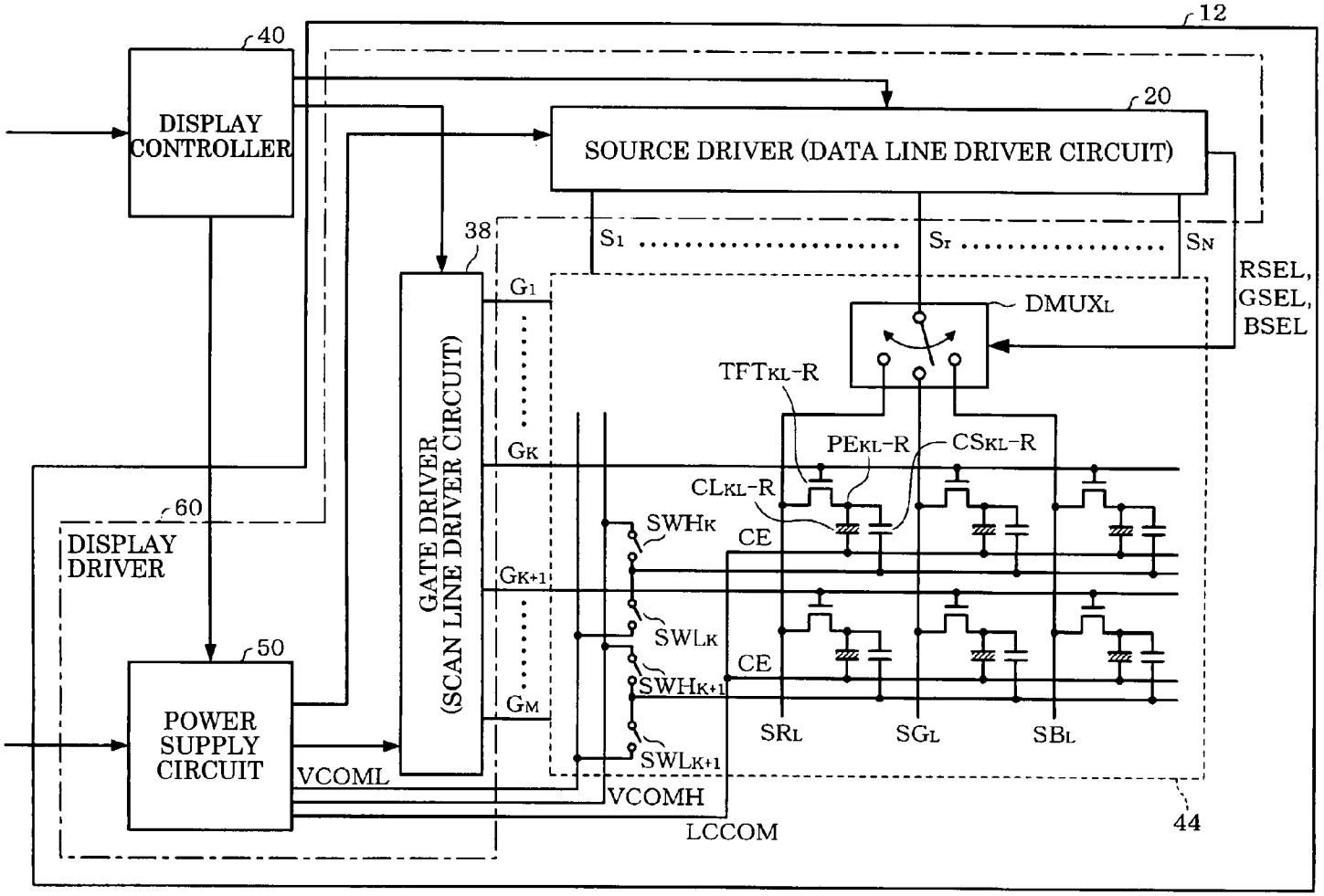
FIG. 2 is a view showing another configuration example of a liquid crystal display device according to one embodiment of the invention.

FIG. 2 shows another configuration example of the liquid crystal display device according to this embodiment.

In FIG. 2, the display driver 60 which includes the source driver 20, the gate driver 38, and the power supply circuit 50 is formed on the display panel 12 (panel substrate). Specifically, the display panel 12 may be configured to include a plurality of gate lines, a plurality of source lines, a plurality of pixels (pixel electrodes), each of which is connected to the corresponding gate line and the corresponding source line, a source driver which drives the source lines, and a gate driver which scans the gate lines. The pixels are formed in a pixel formation region 44 of the display panel 12. Each pixel may include a TFT, of which the source is connected to the source line and the gate is connected to the gate line, and a pixel electrode connected to the drain of the TFT.

In FIG. 2, at least one of the gate driver 38 and the power supply circuit 50 may be omitted from the display panel 12.

In FIG. 1 or 2, the display driver 60 may include the display controller 40. In FIG. 1 or 2, the display driver 60 may be a semiconductor device formed by integrating the source driver 20 or the gate driver 38 and the power supply circuit 50.

Figure 3:
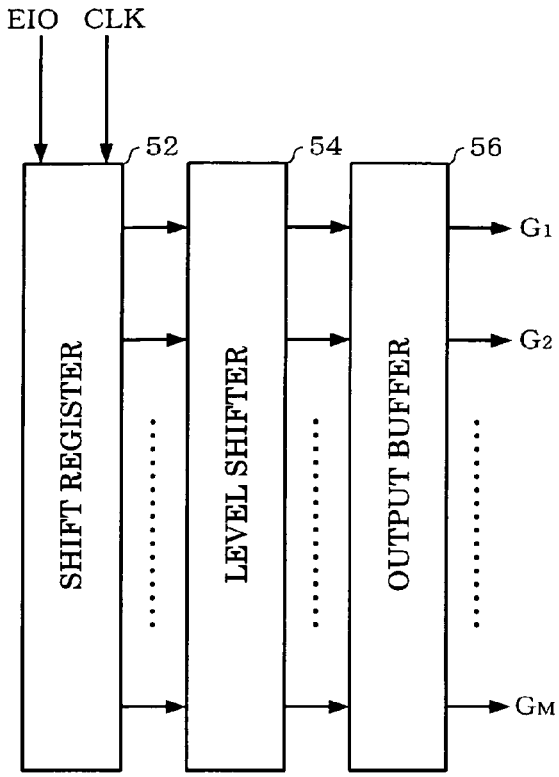
FIG. 3 is a block diagram showing a configuration example of a gate driver shown in FIG. 1 or 2.

FIG. 3 shows a configuration example of the gate driver 38 shown in FIG. 1 or 2.

The gate driver 38 includes a shift register 52, a level shifter 54, and an output buffer 56.

The shift register 52 includes a plurality of flip-flops which are provided corresponding to the gate lines and sequentially connected. The shift register 52 holds an enable input-output signal EIO in the flip-flop in synchronization with a clock signal CLK, and sequentially shifts the enable input-output signal EIO to the adjacent flip-flops in synchronization with the clock signal CLK. The enable input-output signal EIO input to the shift register 52 is a vertical synchronization signal supplied from the display controller 40.

The level shifter 54 shifts the voltage level from the shift register 52 to a voltage level corresponding to the liquid crystal element of the display panel 12 and the transistor performance of the TFT. Since a high voltage level is required as the above voltage level, a high voltage process differing from that of other logic circuit sections is used for the level shifter 54.

The output buffer 56 buffers a scan voltage shifted by the level shifter 54, and outputs the scan voltage to the gate line to drive the gate line.

Figure 4:
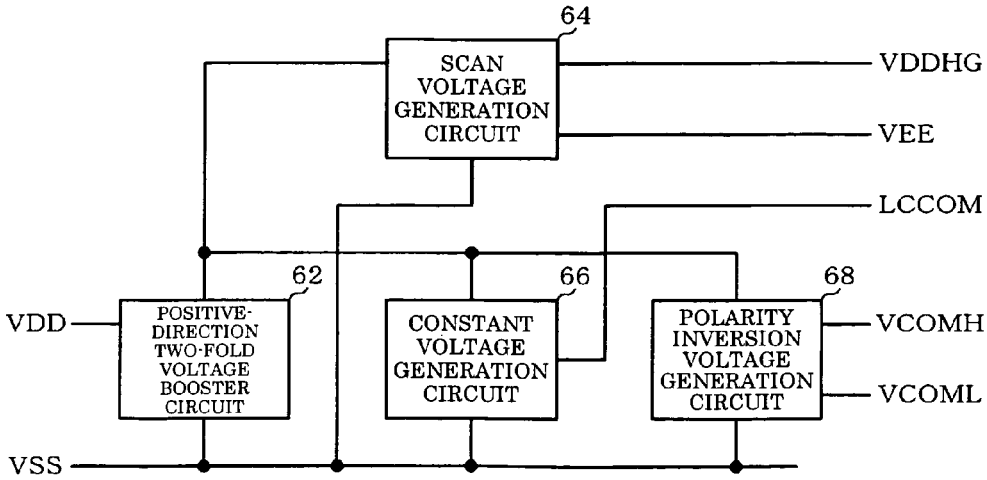
FIG. 4 is a block diagram showing a configuration example of a power supply circuit shown in FIG. 1 or 2.

FIG. 4 shows a configuration example of the power supply circuit 50 shown in FIG. 1 or 2.

The power supply circuit 50 includes a positive-direction two-fold voltage booster circuit 62, a scan voltage generation circuit 64, a constant voltage generation circuit 66, and a polarity inversion voltage generation circuit 68. A system ground power supply voltage VSS and a system power supply voltage VDD are supplied to the power supply circuit 50.

The system ground power supply voltage VSS and the system power supply voltage VDD are supplied to the positive-direction two-fold voltage booster circuit 62. The positive-direction two-fold voltage booster circuit 62 generates a power supply voltage VOUT by raising the system power supply voltage VDD in the positive direction by a factor of two with respect to the system ground power supply voltage VSS. Specifically, the positive-direction two-fold voltage booster circuit 62 increases the voltage difference between the system ground power supply voltage VSS and the system power supply voltage VDD by a factor of two. The positive-direction two-fold voltage booster circuit 62 may be formed using a known charge-pump circuit. The power supply voltage VOUT is supplied to the source driver 20, the scan voltage generation circuit 64, the constant voltage generation circuit 66, and the polarity inversion voltage generation circuit 68. It is desirable that the positive-direction two-fold voltage booster circuit 62 output the power supply voltage VOUT obtained by raising the system power supply voltage VDD in the positive direction by a factor of two by raising the system power supply voltage VDD by a factor equal to or larger than two and then regulating the voltage level using a regulator.

The system ground power supply voltage VSS and the power supply voltage VOUT are supplied to the scan voltage generation circuit 64. The scan voltage generation circuit 64 generates the scan voltage. The scan voltage is a voltage applied to the gate line driven by the gate driver 38. The high-potential-side voltage and the low-potential-side voltage of the scan voltage are voltages VDDHG and VEE, respectively.

The system ground power supply voltage VSS and the power supply voltage VOUT are supplied to the constant voltage generation circuit 66. The constant voltage generation circuit 66 generates an intermediate voltage (=(VOUT+VSS)/2) between the system ground power supply voltage VSS and the power supply voltage VOUT as the constant voltage LCCOM, for example. The constant voltage LCCOM is applied to the common electrode CE regardless of the polarity inversion timing.

The polarity inversion voltage generation circuit 68 generates the high-potential-side voltage VCOMH and the low-potential-side voltage VCOML of the polarity inversion voltage VCOM. The high-potential-side voltage VCOMH or the low-potential-side voltage VCOML is applied to the other end of the storage capacitor of the display panel 12 based on a polarity inversion signal POL, for example. The polarity inversion signal POL is generated by the display controller 40 in synchronization with the polarity inversion timing.

Figure 5:
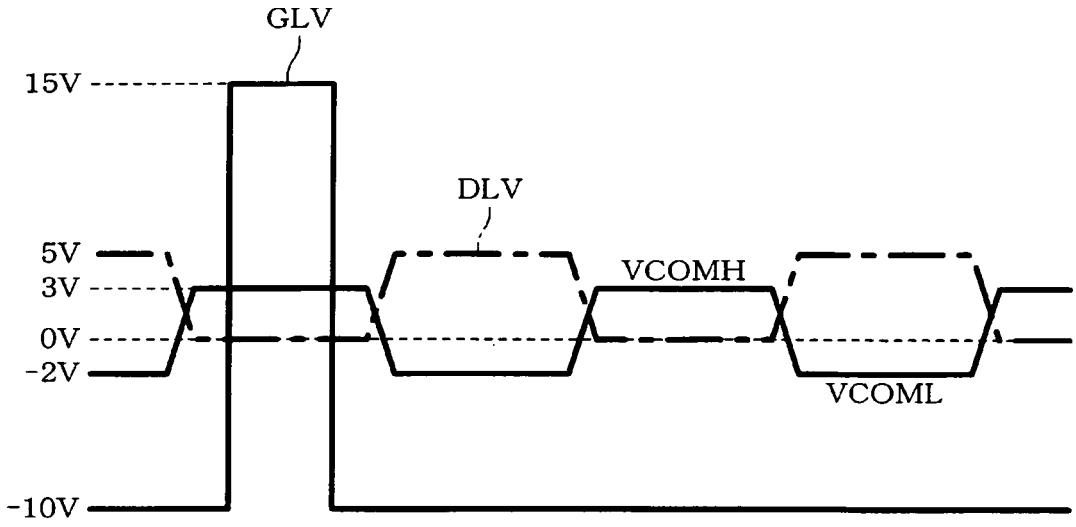
FIG. 5 is a view showing an example of a drive waveform of a display panel shown in FIG. 1 or 2.

FIG. 5 shows an example of the drive waveform of the display panel 12 shown in FIG. 1 or 2.

A grayscale voltage (grayscale signal in a broad sense) DLV corresponding to the grayscale value of the grayscale data is applied to the source line. In FIG. 5, the grayscale voltage DLV having an amplitude of 5 V with respect to the system ground power supply voltage VSS (=0 V) is applied to the source line.

A scan voltage GLV at the low-potential-side voltage VEE (=−10 V) is applied to the gate line as an unselect voltage in an unselected state, and a scan voltage GLV at the high-potential-side voltage VDDHG (=15 V) is applied to the gate line as a select voltage in a selected state.

The high-potential-side voltage VCOMH (=3 V) or the low-potential-side voltage VCOML (=−2 V) is applied to the other end of the storage capacitor as the polarity inversion voltage VCOM. The polarity of the voltage level of the liquid crystal with respect to a given voltage is reversed in synchronization with the polarity inversion timing. FIG. 5 shows the waveform during scan line inversion drive. The polarity of the grayscale voltage DLV applied to the source line is also reversed with respect to a given voltage in synchronization with the polarity inversion timing.

A liquid crystal element deteriorates when a direct-current voltage is applied to the liquid crystal element for a long period of time. This makes it necessary to employ a drive method which reverses the polarity of the voltage applied to the liquid crystal element each time a given period has expired. As such a drive method, frame inversion drive, scan (gate) line inversion drive, data (source) line inversion drive, dot inversion drive, and the like are known.

Frame inversion drive reduces power consumption, but results in a poor image quality. Data line inversion drive and dot inversion drive provide an excellent image quality, but require a high voltage for driving a display panel.

This embodiment employs scan line inversion drive. In scan line inversion drive, the polarity of the voltage applied to the liquid crystal element is reversed each time a scan period has expired (i.e., scan line units). For example, a positive voltage is applied to the liquid crystal element in the first scan period (scan line), a negative voltage is applied to the liquid crystal element in the second scan period, and a positive voltage is applied to the liquid crystal element in the third scan period. In the subsequent frame, a negative voltage is applied to the liquid crystal element in the first scan period, a positive voltage is applied to the liquid crystal element in the second scan period, and a negative voltage is applied to the liquid crystal element in the third scan period.

In scan line inversion drive, the polarity of the voltage level of the polarity inversion voltage is reversed each time the scan period has expired.

Figure 6:
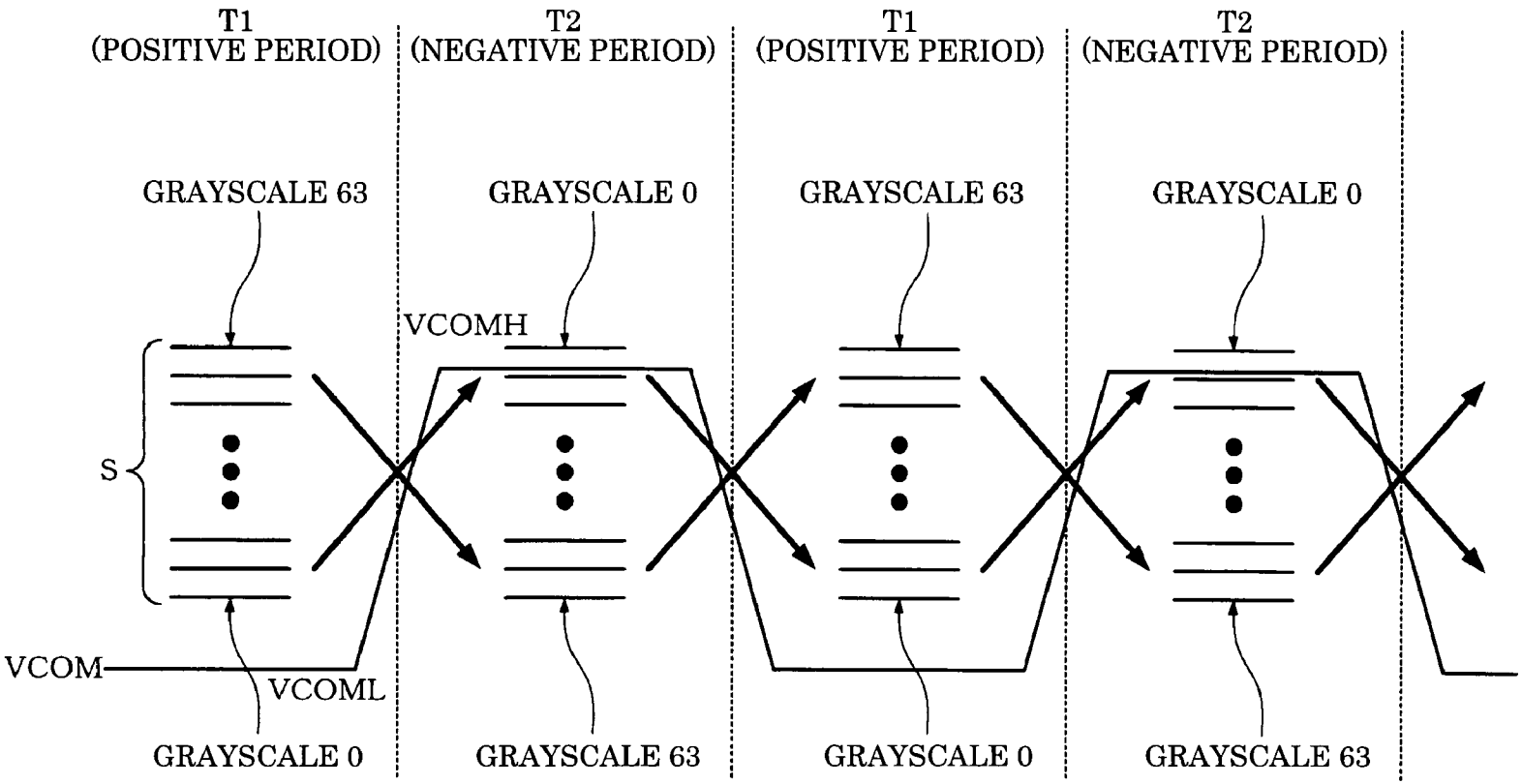
FIG. 6 is a view illustrative of polarity inversion drive according to one embodiment of the invention.

As shown in FIG. 6, the voltage level of the polarity inversion voltage is set at the low-potential-side voltage VCOML in a positive period T1 (first period) and is set at the high-potential-side voltage VCOMH in a negative period T2 (second period). The polarity of the grayscale voltage applied to the source line is also reversed at the above timing. Note that the voltage level of the low-potential-side voltage VCOML is the reverse of that of the high-potential-side voltage VCOMH with respect to a given voltage level.

The positive period T1 refers to a period in which the voltage level of the pixel electrode to which the grayscale voltage is supplied through the source line is higher than the voltage level of the common electrode CE. In the positive period T1, a positive voltage is applied to the liquid crystal element. The negative period T2 refers to a period in which the voltage level of the pixel electrode to which the grayscale voltage is supplied through the source line is lower than the voltage level of the common electrode CE. In the negative period T2, a negative voltage is applied to the liquid crystal element.

A voltage necessary for driving the display panel can be reduced using the polarity inversion voltage. This makes it possible to reduce the withstand voltage of the driver circuit, thereby simplifying the driver circuit manufacturing process and reducing the manufacturing cost.

Figure 7:
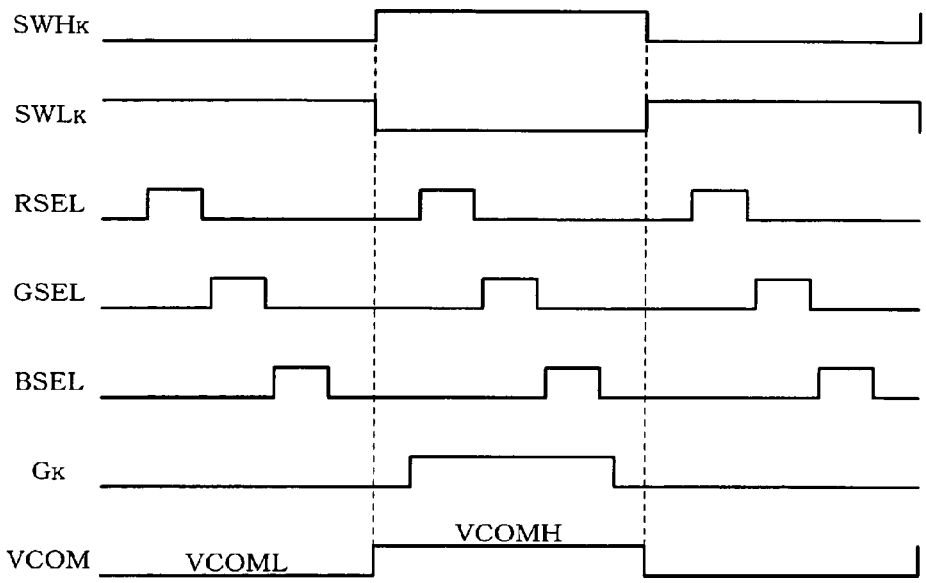
FIG. 7 is a timing diagram showing a control example of a liquid crystal display device according to one embodiment of the invention.

FIG. 7 is a timing diagram showing a control example of the liquid crystal display device according to this embodiment.

FIG. 7 shows only a control example of the switch circuit provided corresponding to the gate line $G_K$. Note that the same description also applies to other gate lines. The switching elements $SWH_K$ and $SWL_K$ are alternately (exclusively) turned ON. Specifically, the switching element $SWL_K$ is turned ON when the switching element $SWH_K$ is turned OFF, and the switching element $SWL_K$ is turned OFF when the switching element $SWH_K$ is turned ON. The switch circuit outputs the high-potential-side voltage VCOMH when the switching element $SWH_K$ is turned ON, and outputs the low-potential-side voltage VCOML when the switching element $SWL_K$ is turned ON.

The multiplex control signals RSEL, GSEL, and BSEL input to the demultiplexer $DMUX_L$ are turned ON in that order within one horizontal scan period in which the gate line $G_K$ is selected. When the multiplex control signal RSEL is turned ON, the voltage of the source voltage supply line $S_L$ is supplied to the source line $SR_L$. When the multiplex control signal GSEL is turned ON, the voltage of the source voltage supply line $S_L$ is supplied to the source line $SG_L$. When the multiplex control signal BSEL is turned ON, the voltage of the source voltage supply line $S_L$ is supplied to the source line $SB_L$.

1.1 Outline of Capacitive Coupling Drive Method

An outline of a capacitive coupling drive method is described below.

The capacitance of the liquid crystal capacitor $CL_{KL}$-R (element capacitor in a broad sense) is referred to as $C_L$, the capacitance of the storage capacitor $CS_{KL}$-R is referred to as $C_S$, and the grayscale voltage supplied to the pixel electrode is referred to as GV. When the polarity inversion voltage VCOM is either the high-potential-side voltage VCOMH (e.g., 5 V) or the low-potential-side voltage VCOML (e.g., 0 V), the following equation is satisfied before and after the polarity inversion timing in accordance with the principle of charge conservation.

$$C_L \times GV + C_S \times (GV+0) = C_L \times GV + C_S \times (GV+5) = C_L \times GV + C_S \times GV + 5 \times C_S \quad (1)$$

In the equation (1), when the capacitance $C_L$ is equal to the capacitance $C_S$, a charge in an amount of $5 \times C_S$ is redistributed between the liquid crystal capacitor $CL_{KL}$-R and the storage capacitor $CS_{KL}$-R. Therefore, the voltage of the pixel electrode $PE_{KL}$-R increases by 2.5 (=5/2) V, for example. Specifically, the voltage of the pixel electrode $PE_{KL}$-R can be changed by a given voltage determined by the capacitance $C_L$, the capacitance $C_S$, the high-potential-side voltage VCOMH, and the low-potential-side voltage VCOML. For example, the voltage of the pixel electrode can be increased by a given voltage by changing the polarity inversion voltage VCOM from the low-potential-side voltage VCOML to the high-potential-side voltage VCOMH. The voltage of the pixel electrode can be decreased by a given voltage by changing the polarity inversion voltage VCOM from the high-potential-side voltage VCOMH to the low-potential-side voltage VCOML.

Since the voltage of the pixel electrode can be thus increased or decreased by a given voltage irrespective of the grayscale voltage, the amplitude of the grayscale voltage GV can be decreased, whereby power consumption can be further reduced.

1.2 Details of Embodiment

The source line and the common electrode are capacitively coupled, and the source line and the electrode to which the polarity inversion voltage VCOM is applied are capacitively coupled. Therefore, when the potential of the source line changes, the potential of the polarity inversion voltage VCOM also changes.

Figure 8:
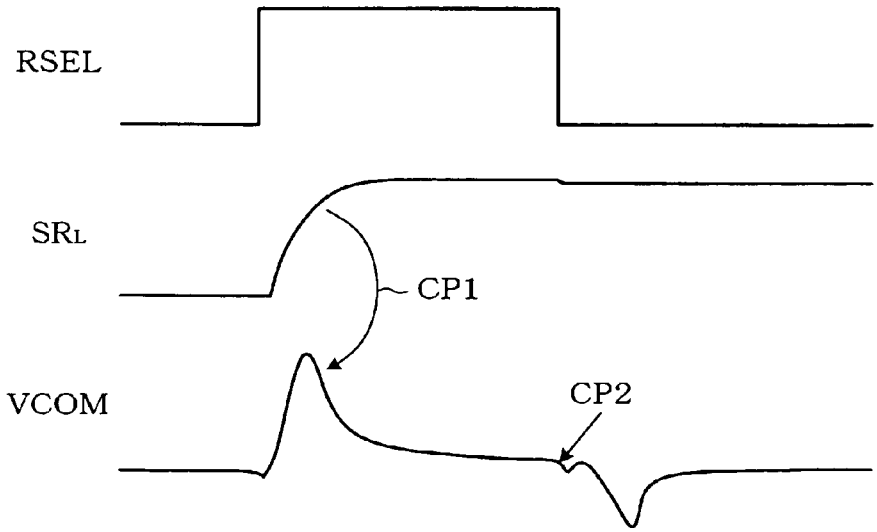
FIG. 8 is a view illustrative of the operation of a liquid crystal display device according to a comparative example of one embodiment of the invention.

FIG. 8 is a view illustrative of the operation of a liquid crystal display device according to a comparative example of this embodiment.

For example, when the multiplex control signal RSEL of the demultiplexer $DMUX_L$ is turned ON so that the potential of the source line $SR_L$ changes, the potential of the polarity inversion voltage VCOM also changes. In FIG. 8, when the potential of the source line $SR_L$ increases, the potential of the electrode to which the polarity inversion voltage VCOM is applied and which is capacitively coupled with the source line $SR_L$ also increases (CP1). The original potential of the polarity inversion voltage VCOM is recovered through the switching elements $SWH_K$ and $SWL_K$ of the switch circuit.

However, when the switching elements $SWH_K$ and $SWL_K$ of the switch circuit have a high on-resistance, the voltage of the electrode to which the polarity inversion voltage VCOM is applied changes with a time constant determined by the product of the parasitic capacitance of the electrode to which the polarity inversion voltage VCOM is applied and the on-resistance of the switching element. As a result, a situation in which the original potential of the polarity inversion voltage VCOM is not recovered occurs, as shown in FIG. 8 (CP2). This causes the voltage applied to the liquid crystal to become insufficient, whereby crosstalk may occur. This phenomenon occurs to a larger extent as the resolution and the grayscale level of the display panel 12 increase, whereby image quality deteriorates.

In order to deal with this problem, this embodiment provides a liquid crystal display device and the like suitable for the above-described capacitive coupling drive method.

Figure 9:
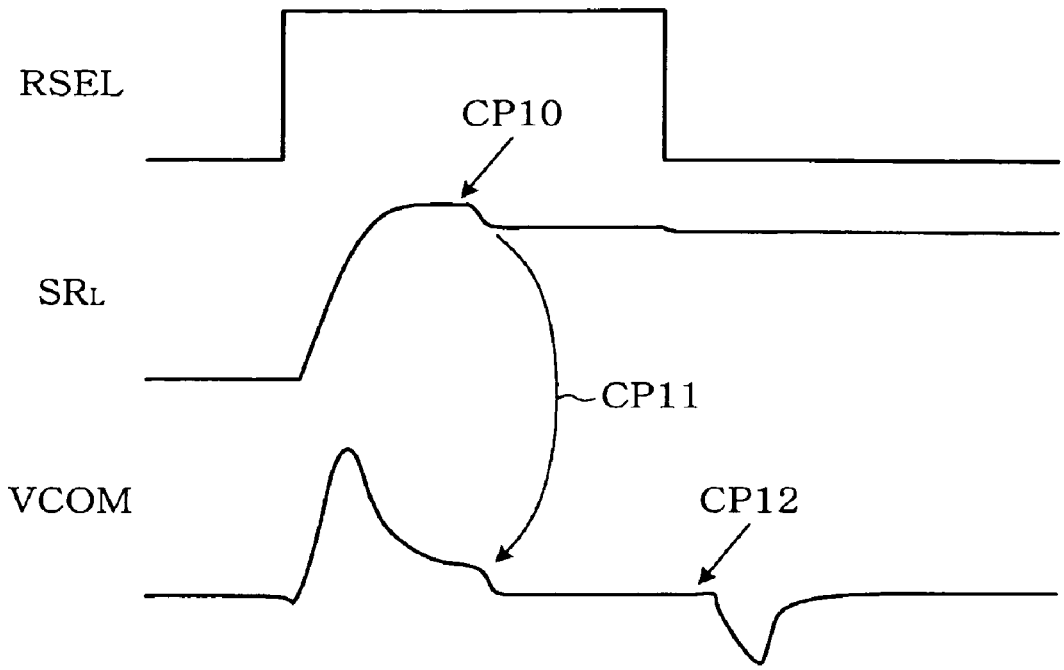
FIG. 9 is a view illustrative of the drive principle of a liquid crystal display device according to one embodiment of the invention.

FIG. 9 is a view illustrative of the drive principle of the liquid crystal display device according to this embodiment.

As shown in FIG. 9, when the multiplex control signal RSEL is turned ON so that the potential of the source line $SR_L$ increases, the potential of the electrode to which the polarity inversion voltage VCOM is applied and which is capacitively coupled with the source line $SR_L$ also increases. In this case, the source driver 20 according to this embodiment calculates an offset value based on an evaluation value (e.g., value obtained by adding up R-component grayscale data or converted voltage value data corresponding to the present scan line) of the R-component grayscale data (or converted voltage value data obtained by converting the grayscale data into a voltage value) corresponding to the present scan line. The source driver 20 supplies a grayscale voltage (grayscale signal) corresponding to data obtained by adding up the offset value and the R-component grayscale data to the source line $SR_L$. This causes the potential of the source line $SR_L$ to be shifted to the high potential side as compared with the grayscale voltage which should be originally applied, for example (CP10). The source driver 20 then cancels the offset value and applies the grayscale voltage which should be originally applied to the source line $SR_L$ (CP11).

As a result, the original potential of the polarity inversion voltage VCOM is recovered through the switching elements $SWH_K$ and $SWL_K$ of the switch circuit. Since the source line $SR_L$ is driven while applying the offset value and is then driven while canceling the offset value, the source line $SR_L$ is quickly stabilized, whereby a change in the polarity inversion voltage VCOM is suppressed (CP12). Therefore, a change in the voltage of the electrode to which the polarity inversion voltage VCOM is applied can be suppressed in a short period of time even when the switching elements $SWH_K$ and $SWL_K$ of the switch circuit have a high on-resistance. This prevents a situation in which the voltage applied to the liquid crystal becomes insufficient, whereby crosstalk can be prevented.

1.3 Source Driver 1.3.1 First Configuration Example

Figure 10:
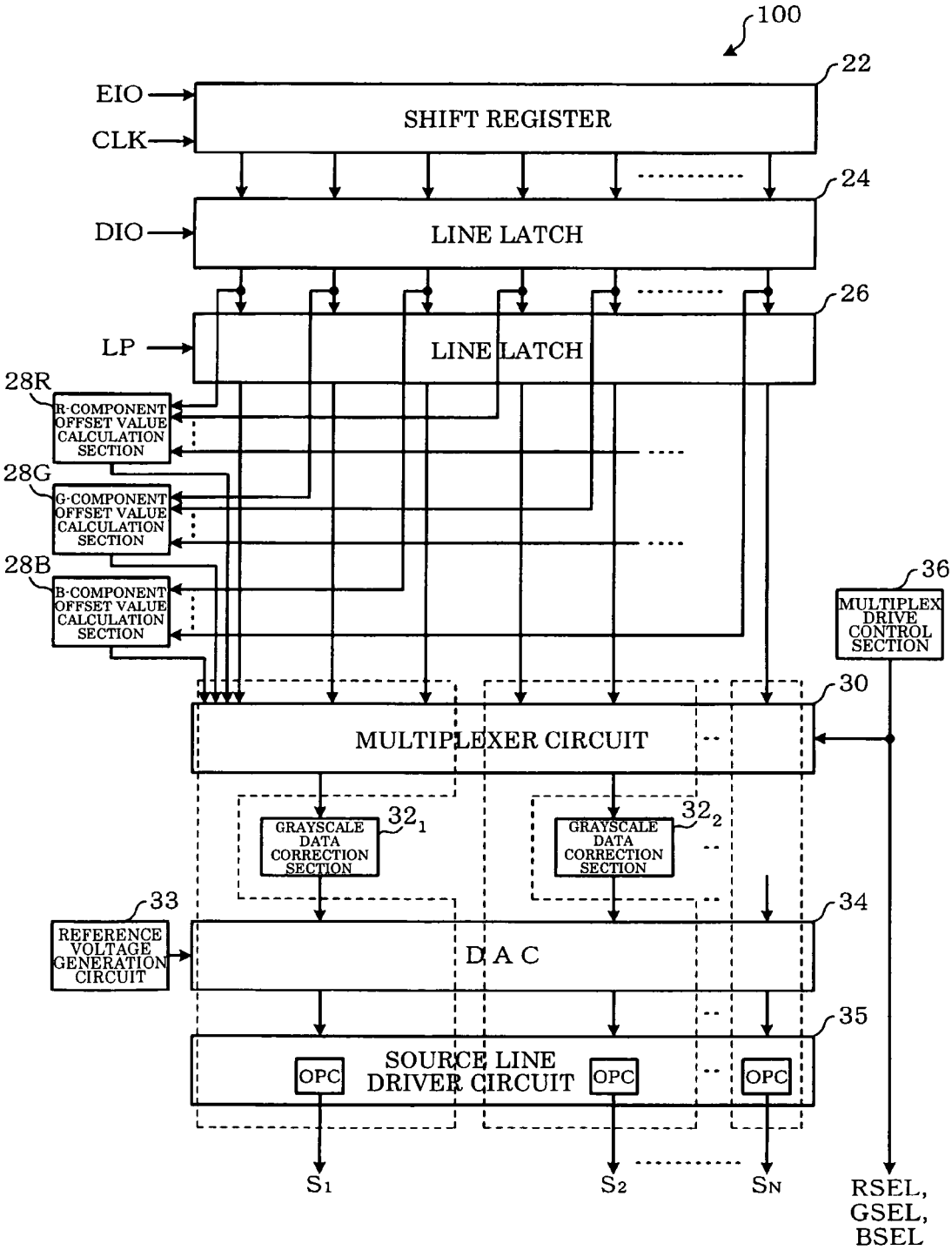
FIG. 10 is a block diagram showing a configuration example of a source driver according to a first configuration example of one embodiment of the invention.

FIG. 10 is a block diagram showing a configuration example of a source driver according to a first configuration example of this embodiment.

A source driver 100 according to the first configuration example can be applied to a liquid crystal display device as the source driver 20 shown in FIG. 1 or 2. The following description is given on the assumption that one pixel is made up of three dots and the source lines are driven in the order of the R component, the G component, and the B component.

The source driver 100 according to the first configuration example includes a shift register 22, line latches 24 and 26, an R-component offset value calculation section 28R (offset value calculation section in a broad sense), a G-component offset value calculation section 28C, a B-component offset value calculation section 28B, a multiplexer circuit 30, grayscale data correction sections $\mathbf{32}_1$ to $\mathbf{32}_N$, a reference voltage generation circuit 33, a digital-to-analog converter (DAC) 34 (data voltage generation circuit in a broad sense), a source line driver circuit 35, and a multiplex drive control section 36. Specifically, the offset value calculation sections are respectively provided corresponding to the color components of one pixel.

The shift register 22 includes a plurality of flip-flops which are provided corresponding to the source lines and sequentially connected. The shift register 22 holds the enable input-output signal EIO in synchronization with the clock signal CLK, and sequentially shifts the enable input-output signal EIO to the adjacent flip-flops in synchronization with the clock signal CLK.

Grayscale data (DIO) is input to the line latch 24 from the display controller 40 in units of 18 bits (6 bits (grayscale data)×3 (RGB)), for example. The line latch 24 latches the grayscale data (DIO) in synchronization with the enable input-output signal EIO which is sequentially shifted by the flip-flops of the shift register 22.

The line latch 26 latches the grayscale data of one horizontal scan latched by the line latch 24 in synchronization with a horizontal synchronization signal LP supplied from the display controller 40.

The R-component offset value calculation section 28R calculates an R-component offset value (first-color-component offset value) based on R-component grayscale data. Specifically, the R-component offset value calculation section 28R calculates the R-component offset value based on the R-component grayscale data corresponding to one scan line (one horizontal scan). For example, the R-component offset value calculation section 28R may add up the R-component grayscale data corresponding to one scan line (one horizontal scan), and output an offset value corresponding to the addition result.

The G-component offset value calculation section 28G calculates a G-component offset value (second-color-component offset value) based on G-component grayscale data. Specifically, the G-component offset value calculation section 28G calculates the G-component offset value based on the G-component grayscale data corresponding to one scan line (one horizontal scan). For example, the G-component offset value calculation section 28G may add up the G-component grayscale data corresponding to one scan line (one horizontal scan), and output an offset value corresponding to the addition result.

The B-component offset value calculation section 28B calculates a B-component offset value (third-color-component offset value) based on B-component grayscale data. Specifically, the B-component offset value calculation section 28B calculates the B-component offset value based on the B-component grayscale data corresponding to one scan line (one horizontal scan). For example, the B-component offset value calculation section 28B may add up the B-component grayscale data corresponding to one scan line (one horizontal scan), and output an offset value corresponding to the addition result.

Note that each of the R-component offset value calculation section 28R, the G-component offset value calculation section 280, and the B-component offset value calculation section 28B may directly generate the sum total data corresponding to one line based on the clock signal CLK, the enable input-output signal EIO, and the grayscale data DIO. In this case, the color component offset value calculation section may sequentially add up the grayscale data DIO at the timing generated based on the clock signal CLK and the enable input-output signal EIO, for example.

The multiplexer circuit 30 multiplexes the grayscale data and the offset value of each color component by time division corresponding to each source output. Specifically, the multiplexer circuit 30 multiplexes the R-component grayscale data, the G-component grayscale data, and the B-component grayscale data of one pixel by time division. The multiplexer circuit 30 multiplexes the R-component offset value, the G-component offset value, and the B-component offset value of one pixel by time division. The time division multiplex timing is specified by the multiplex drive control section 36.

The multiplex drive control section 36 generates multiplex control signals RSEL, GSEL, and BSEL which specify the time division timing of the grayscale voltages supplied to the source voltage supply line. Specifically, the multiplex drive control section 36 generates the multiplex control signals RSEL, GSEL, and BSEL so that the multiplex control signals RSEL, GSEL, and BSEL alternately (sequentially) become active within one horizontal scan period. The multiplexer circuit 30 multiplexes the grayscale data based on the multiplex control signals RSEL, GSEL, and BSEL so that the grayscale voltages are supplied to the source voltage supply line by time division. The multiplex control signals RSEL, GSEL, and BSEL are also supplied to the demultiplexers $\mathrm{DMUX}_1$ to $\mathrm{DMUX}_N$ of the display panel 12.

Each of the grayscale data correction sections $\mathbf{32}_1$ to $\mathbf{30}_N$ corrects the grayscale data of each color component which has been multiplexed by time division using the offset value of each color component which has been similarly multiplexed by time division. Specifically, each grayscale data correction section corrects the grayscale data of each color component by adding up the grayscale data of each color component and the offset value of each color component.

The reference voltage generation circuit 33 generates 64 ($=2^6$) reference voltages. The 64 reference voltages generated by the reference voltage generation circuit 33 are supplied to the DAC 34.

The DAC (data voltage generation circuit) 34 generates an analog data voltage supplied to each source line. Specifically, the DAC 34 selects one of the reference voltages supplied from the reference voltage generation circuit 33 based on the digital grayscale data supplied from the multiplexer circuit 30, and outputs an analog data voltage corresponding to the digital grayscale data.

The source line driver circuit 35 buffers the data voltage supplied from the DAC 34, and outputs the data voltage to the source line to drive the source line. Specifically, the source line driver circuit 35 includes a voltage-follower-connected operational amplifier OPC (impedance conversion circuit in a broad sense) provided corresponding to each source line. Each operational amplifier circuit OPC subjects the data voltage supplied from the DAC 34 to impedance conversion, and outputs the resulting data voltage to the corresponding source line.

FIG. 10 employs a configuration in which the digital grayscale data is subjected to digital-analog conversion and is output to the source line through the source line driver circuit 35. Note that a configuration may also be employed in which an analog image signal is sampled/held and output to the source line through the source line driver circuit 35.

In FIG. 10, the circuit section of the multiplexer circuit 30 which multiplexes the grayscale data and the offset values corresponding to three dots which form one pixel, the circuit section of the DAC 34 corresponding to one source output, and the operational amplifier OPC of the source line driver circuit 35 may be referred to as a source line driver section.

Figure 11:
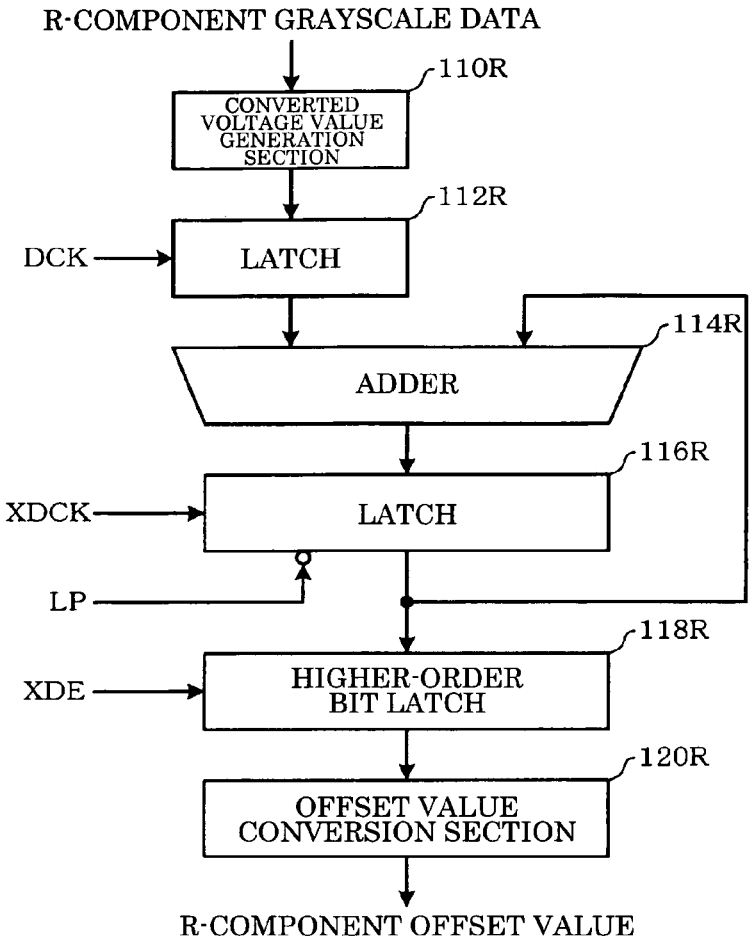
FIG. 11 is a block diagram showing a configuration example of an R-component offset value calculation section.

FIG. 11 is a block diagram showing a configuration example of the R-component offset value calculation section 28R. The G-component offset value calculation section 28G and the B-component offset value calculation section 28B have the same configuration as the R-component offset value calculation section 28R shown in FIG. 11.

The R-component grayscale data corresponding to one scan line is sequentially input to the R-component offset value calculation section 28R. Specifically, the grayscale data is sequentially input to the R-component offset value calculation section 28R in synchronization with the clock signal CLK (dot clock signal DCK). The R-component offset value calculation section 28R includes a converted voltage value generation section 110R, a latch 112R, an adder 114R, a latch 116R, a higher-order bit latch 118R, and an offset value conversion section 120R.

The converted voltage value generation section 110R converts the grayscale data into converted voltage value data in order to reduce an error due to the offset value when evaluating the addition result of the grayscale data to calculate the offset value. The converted voltage value data is used as the corrected grayscale data in the subsequent process.

Figure 12:
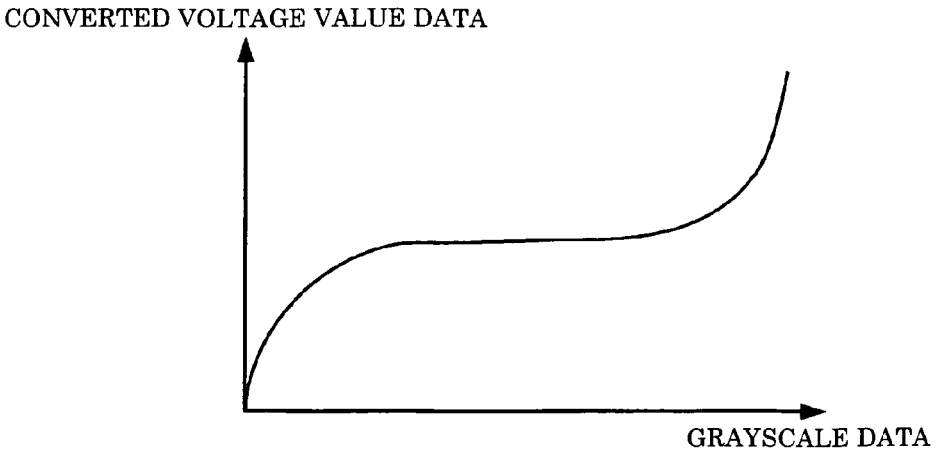
FIG. 12 is a view illustrative of the operation of a converted voltage value generation section shown in FIG. 11.

FIG. 12 is a view illustrative of the operation of the converted voltage value generation section 110R shown in FIG. 11.

The converted voltage value generation section 110R shown in FIG. 11 converts the grayscale data into the converted voltage value data according to the grayscale characteristics of the display panel 12 shown in FIG. 12. Therefore, since the offset value is calculated taking the grayscale characteristics of the display panel 12 into consideration, a change in the polarity inversion voltage VCOM due to the offset value can be reliably suppressed.

In FIG. 11, the latch 112R holds the converted voltage value data supplied from the converted voltage value generation section 110R as the corrected grayscale data in synchronization with the dot clock signal DCK. The latch 116R holds input data at the change timing of a latch pulse LP in synchronization with an inverted dot clock signal XDCK generated by reversing the dot clock signal DCK. The adder 114R adds up the data held by the latch 112R and the data held by the latch 116R. The addition result of the adder 114R is input to the latch 116R.

The higher-order bit latch 118R holds the higher-order four bits of the addition data held by the latch 116R based on a data enable signal XDE, for example. The offset value conversion section 120R outputs an offset value corresponding to the higher-order bit data of the addition data held by the higher-order bit latch 118R as the R-component offset value.

FIG. 13 is a view illustrative of the operation of the offset value conversion section 120R shown in FIG. 11.

The offset value conversion section 120R shown in FIG. 11 outputs an offset value Roffset corresponding to higher-order bit data RSUM of the addition data held by the higher-order bit latch 118R according to a table shown in FIG. 13.

FIG. 13 shows a case where the higher-order bit latch 118R holds the higher-order four-bit data of the addition data. In this case, 16 ($=2^4$) types of data are input as the higher-order bit data RSUM, and the offset value conversion section 120R outputs less than 16 types (e.g., eight types) of offset values Roffset.

The R-component offset value, the G-component offset value, and the B-component offset value thus converted are supplied to the multiplexer circuit 30 as the offset values of the respective color components in the horizontal scan period.

Figure 14:
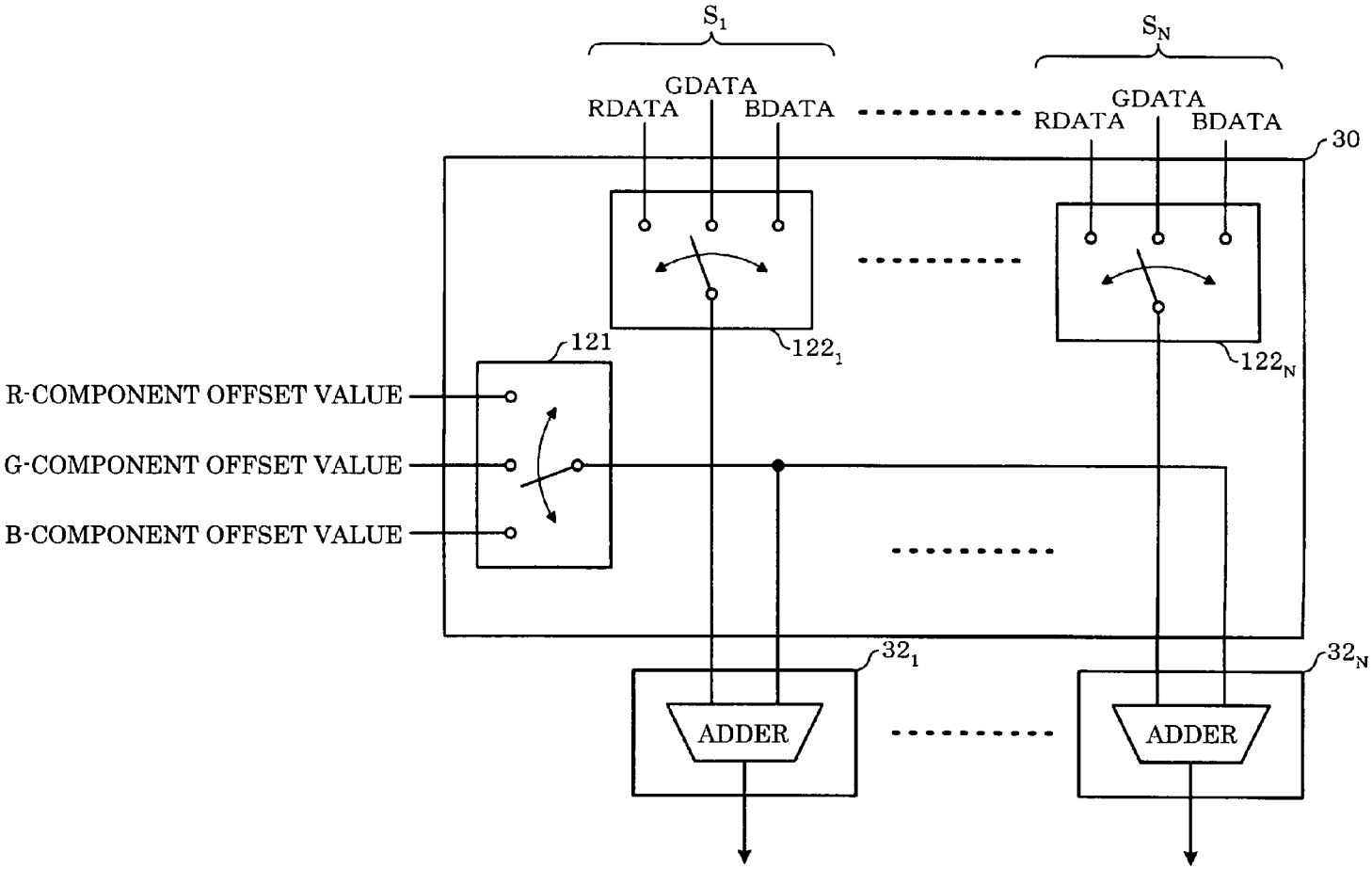
FIG. 14 is a view showing a configuration example of a multiplexer circuit and a grayscale data correction section shown in FIG. 10.

FIG. 14 shows a configuration example of the multiplexer circuit 30 and the grayscale data correction sections $\mathbf{32}_1$ to $\mathbf{32}_N$ shown in FIG. 10.

The multiplexer circuit 30 includes an offset value multiplexer 121 and grayscale data multiplexers $\mathbf{122}_1$ to $\mathbf{122}_N$ respectively provided corresponding to the source outputs.

The offset value multiplexer 121 multiplexes the R-component offset value Roffset supplied from the R-component offset value calculation section 28R shown in FIG. 10, the G-component offset value Goffset supplied from the G-component offset value calculation section 28G, and the B-component offset value Boffset supplied from the B-component offset value calculation section 28B at the time division timing specified by the multiplex control signals RSEL, GSEL, and BSEL output from the multiplex drive control section 36. The offset values multiplexed by the offset value multiplexer 121 are supplied to each of the grayscale data correction sections $\mathbf{32}_1$ to $\mathbf{32}_N$.

Each of the grayscale data multiplexers $\mathbf{122}_1$ to $\mathbf{122}_N$ multiplexes R-component grayscale data RDATA, G-component grayscale data GDATA, and B-component grayscale data BDATA of one pixel at the time division timing specified by the multiplex control signals RSEL, GSEL, and BSEL output from the multiplex drive control section 36. The grayscale data multiplexed by each grayscale data multiplexer is supplied to the corresponding grayscale data correction section among the grayscale data correction sections $\mathbf{32}_1$ to $\mathbf{32}_N$.

Figure 15:
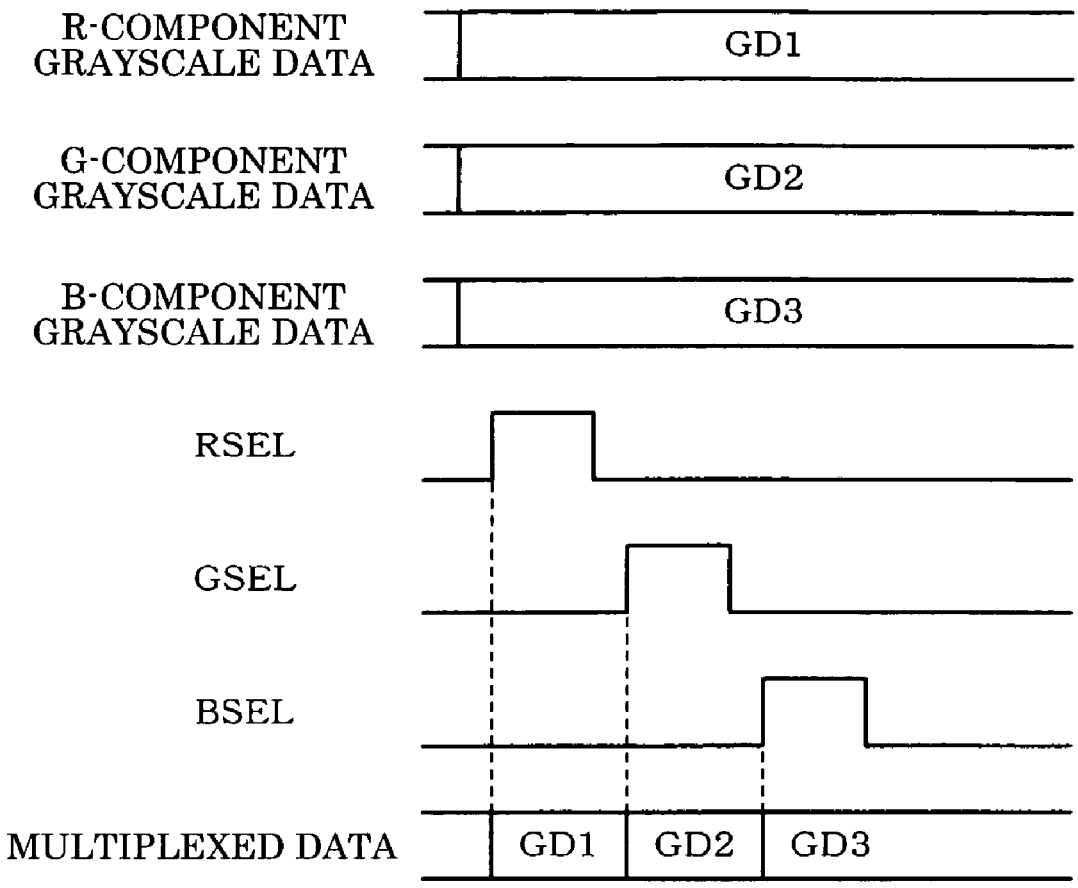
FIG. 15 is a view illustrative of the operation of each grayscale data multiplexer shown in FIG. 14.

FIG. 15 is a view illustrative of the operation of each grayscale data multiplexer shown in FIG. 14.

In FIG. 15, the R-component grayscale data, the G-component grayscale data, and the B-component grayscale data multiplexed by each grayscale data multiplexer are referred to as GD1, GD2, and GD3, respectively. Each of the multiplex control signals RSEL, GSEL, and BSEL generated by the multiplex drive control section 36 becomes active once within one horizontal scan period, for example. Each grayscale data multiplexer selectively outputs the R-component grayscale data GD1 when the multiplex control signal RSEL has become active, selectively outputs the G-component grayscale data GD2 when the multiplex control signal GSEL has become active, and selectively outputs the B-component grayscale data GD3 when the multiplex control signal BSEL has become active. As a result, each grayscale data multiplexer can generate multiplexed data in which the R-component grayscale data GD1, the G-component grayscale data GD2, and the B-component grayscale data GD3 are multiplexed by time division, and supply the multiplexed data to the corresponding grayscale data correction section among the grayscale data correction sections $\mathbf{32}_1$ to $\mathbf{32}_N$.

Each of the grayscale data correction sections $\mathbf{32}_1$ to $\mathbf{32}_N$ adds up the multiplexed data which has been multiplexed corresponding to each source output and the multiplexed offset values. Each grayscale data correction section adds up the R-component grayscale data contained in the multiplexed data and the R-component offset value contained in the multiplexed offset values, adds up the G-component grayscale data contained in the multiplexed data and the G-component offset value contained in the multiplexed offset values, and adds up the B-component grayscale data contained in the multiplexed data and the B-component offset value contained in the multiplexed offset values. As a result, the offset value is added to the grayscale data in a time-division-multiplexed state. The grayscale data thus corrected is supplied to the DAC 34.

Note that data in which the grayscale data corrected by each of the grayscale data correction sections $\mathbf{32}_1$ to $\mathbf{32}_N$ is multiplexed is supplied to the DAC 34, and data in which the grayscale data which is not corrected by each grayscale data correction section is multiplexed is then supplied to the DAC 34 after a predetermined period has elapsed.

In FIG. 10, it suffices to provide the adders in a number corresponding to the number of source outputs by providing the grayscale data correction sections $\mathbf{32}_1$ to $\mathbf{32}_N$ in the subsequent stage of the multiplexer circuit 30. Note that the grayscale data correction sections may be provided in the preceding stage of the multiplexer circuit 30. In this case, it is necessary to provide the adders in a number corresponding to the number of dots of one scan line before multiplexing the grayscale data.

Each decoder of the DAC 34 selects the grayscale voltage corresponding to each piece of the grayscale data GD1 to GD3 multiplexed into the multiplexed data from the 64 reference voltages. As a result, each decoder of the DAC 34 outputs a grayscale voltage in which first to third grayscale voltages are multiplexed in the multiplexed data. Specifically, the DAC 34 generates first to third grayscale voltages respectively corresponding to the grayscale data multiplexed by the multiplexer circuit 30.

Figure 16:
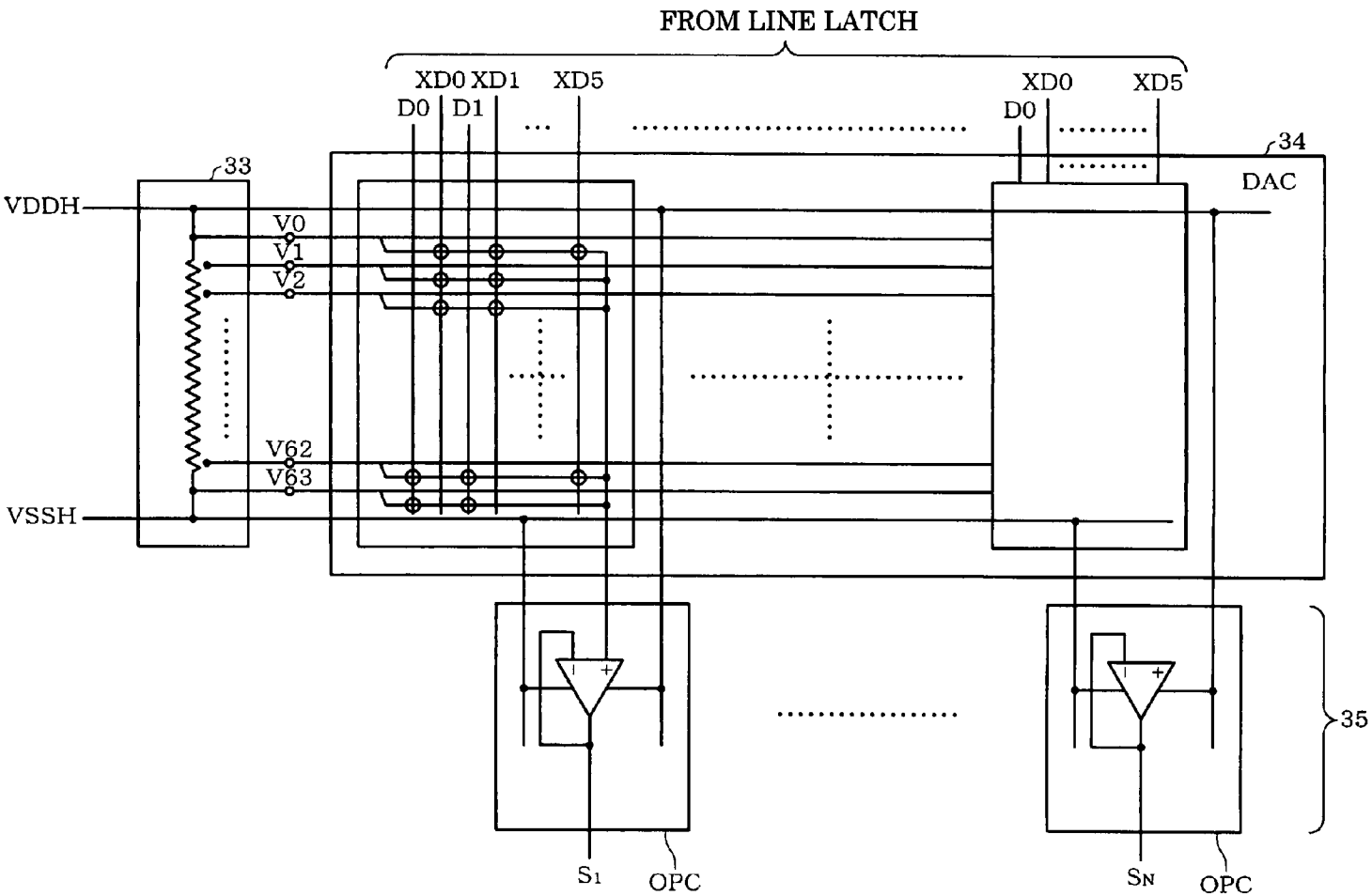
FIG. 16 is a view showing a configuration example of a reference voltage generation circuit, a DAC, and a source line driver circuit shown in FIG. 10.

FIG. 16 shows a configuration example of the reference voltage generation circuit 33, the DAC 34, and the source line driver circuit 35 shown in FIG. 10. In FIG. 16, the grayscale data is made up of 6-bit data D0 to D5, and inverted data of each bit of the grayscale data is indicated by XD0 to XD5. In FIG. 16, the same sections as in FIG. 10 are indicated by the same symbols. Description of these sections is appropriately omitted.

The reference voltage generation circuit 33 generates 64 reference voltages by dividing the voltage between voltages VDDH and VSSH using resistors. Each reference voltage corresponds to a grayscale value indicated by the 6-bit grayscale data. Each reference voltage is supplied in common to the source voltage supply lines $S_1$ to $S_N$.

The DAC 34 includes decoders provided corresponding to the source voltage supply lines (source lines). Each decoder outputs the reference voltage corresponding to the grayscale data to the operational amplifier OPC. The first to third grayscale voltages output from each decoder of the DAC 34 are subjected to impedance conversion by the corresponding operational amplifier of the source line driver circuit 35. The output from each operational amplifier OPC of the source line driver circuit 35 is supplied to the demultiplexer of the display panel 12 through the source voltage supply line.

Figure 17:
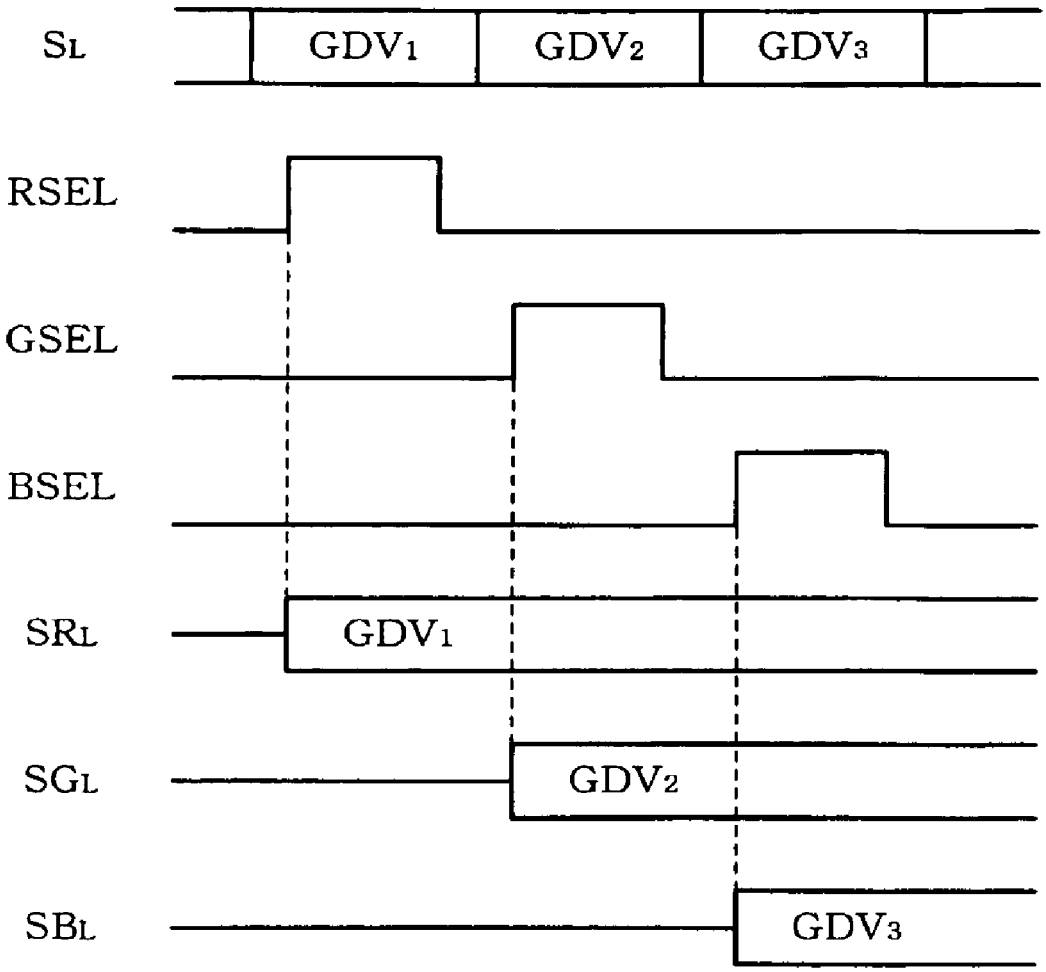
FIG. 17 is a view illustrative of the operation of a demultiplexer shown in FIG. 1 or 2.

FIG. 17 is a view illustrative of the operation of the demultiplexer shown in FIG. 1 or 2.

FIG. 17 shows an operation example of the demultiplexer $DMUX_L$ which separately supplies the grayscale voltages supplied to the source voltage supply line $S_L$ by time division to the source lines $SR_L$, $SG_L$, and $SB_L$. Note that the following description also applies to other demultiplexers.

The demultiplexer $DMUX_L$ separates multiplexed grayscale voltages $GDV_1$, $GDV_2$, and $GDV_3$ supplied to the source voltage supply line $S_L$ using the multiplex control signals RSEL, GSEL, and BSEL, and outputs the separated grayscale voltages $GDV_1$, $GDV_2$, and $GDV_3$ to the source lines $SR_L$, $SG_L$, and $SB_L$.

Specifically, the demultiplexer $DMUX_L$ outputs the multiplexed grayscale voltage (first grayscale voltage $GDV_1$) to the source line $SR_L$ as the first source line when the multiplex control signal RSEL is active, outputs the multiplexed grayscale voltage (second grayscale voltage $GDV_2$) to the source line $SG_L$ as the second source line when the multiplex control signal GSEL is active, and outputs the multiplexed grayscale voltage (third grayscale voltage $GDV_3$) to the source line $SB_L$ as the third source line when the multiplex control signal BSEL is active.

This enables the grayscale voltage to be supplied to the source of the TFT connected to the selected gate line of the display panel 12.

The source driver 100 according to the first configuration example having the above-described configuration calculates the offset value based on the grayscale data of each color component corresponding to one scan line, drives the source line while applying the offset value, and then drives the source line without applying the offset value. Therefore, since the source line can be driven while causing the grayscale voltage to be shifted the high-potential-side or the low-potential-side using the offset value, the potential of the source line $SR_L$ can be changed quickly, whereby the source line $SR_L$ is stabilized quickly so that a change in the polarity inversion voltage VCOM is suppressed. Therefore, a change in the voltage of the electrode to which the polarity inversion voltage VCOM is applied can be suppressed in a short period of time even when the switching elements $SWH_K$ and $SWL_K$ of the switch circuit have a high on-resistance. This prevents a situation in which the voltage applied to the liquid crystal becomes insufficient, whereby crosstalk can be prevented.

1.3.2 Second Configuration Example

In the first configuration example, the offset value is calculated based on the grayscale data corresponding to one scan line. In a second configuration example, an offset value corresponding to the amount of charge stored in the parasitic capacitor of the source line immediately before driving the scan line is calculated. The grayscale data is corrected based on the offset value, and the source line is driven based on the corrected grayscale data.

A source driver according to the second configuration example differs from the source driver 100 according to the first configuration example shown in FIG. 10 as to the R-component offset value calculation section 28R, the G-component offset value calculation section 28G, and the B-component offset value calculation section 28B.

Figure 18:
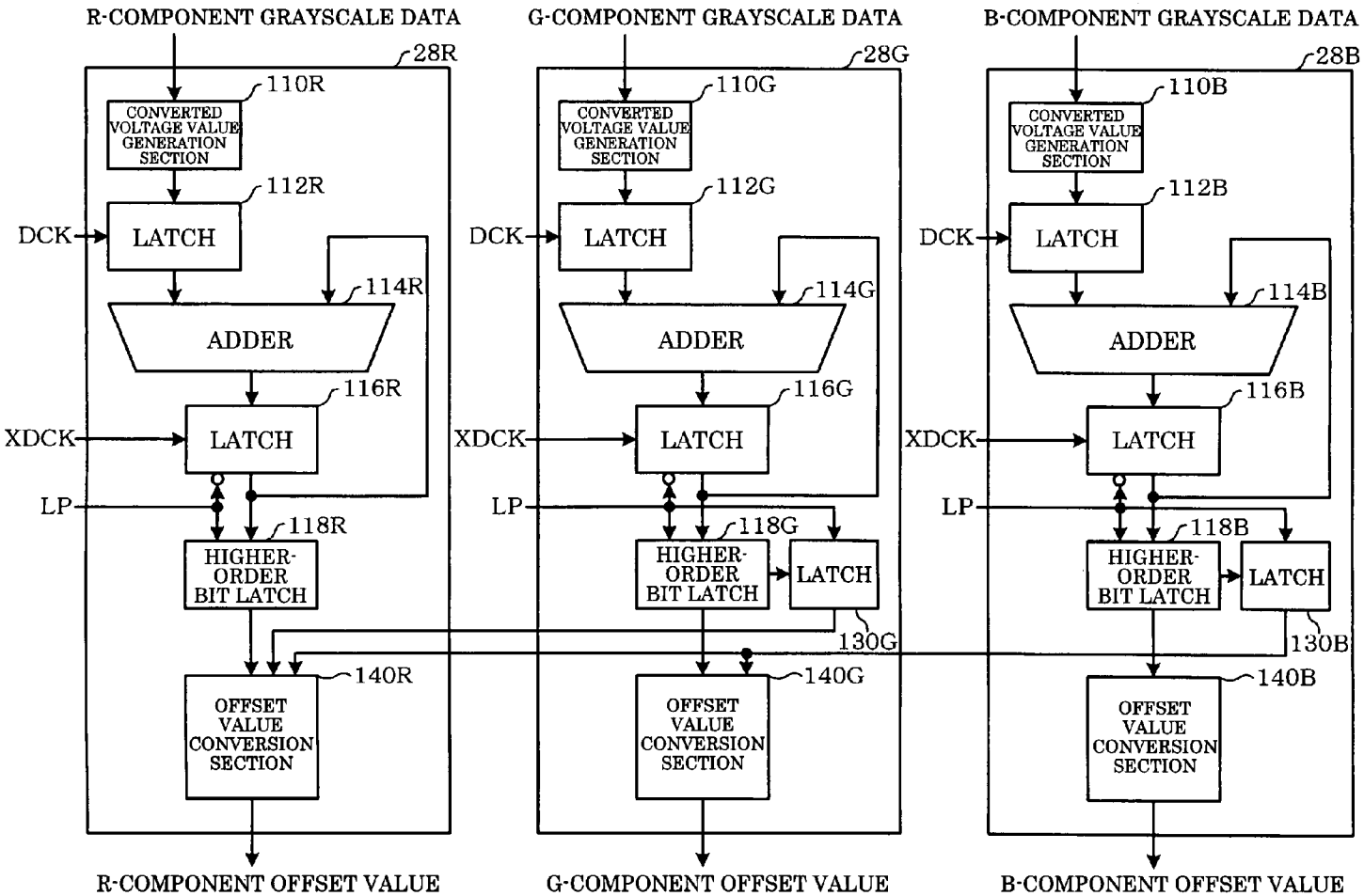
FIG. 18 is a block diagram showing a configuration example of an R-component offset value calculation section, a G-component offset value calculation section, and a B-component offset value calculation section of a source driver according to a second configuration example of one embodiment of the invention.

FIG. 18 is a block diagram showing a configuration example of the R-component offset value calculation section 28, the G-component offset value calculation section 28G, and the B-component offset value calculation section 28B of the source driver according to the second configuration example. In FIG. 18, the same sections as in FIG. 11 are indicated by the same symbols. Description of these sections is appropriately omitted. FIG. 18 illustrates the case where the source lines are driven by time division based on multiplex drive within one horizontal scan period in the order of the R component (first color component), the G component (second color component), and the B component (third color component).

The R-component offset value calculation section according to the second configuration example differs from the R-component offset value calculation section according to the first configuration example in that the higher-order bit latch 118R holds the higher-order bit data of the data latched by the latch 116R at the change timing of the latch pulse LP. An offset value conversion section 140R outputs the R-component offset value based on the R-component higher-order bit data (addition data) corresponding to the present scan line (present line), the G-component higher-order bit data (addition data) corresponding to the preceding scan line, and the B-component higher-order bit data (addition data) corresponding to the preceding scan line.

The G-component offset value calculation section according to the second configuration example differs from the G-component offset value calculation section according to the first configuration example in that the higher-order bit latch 118G holds the higher-order bit data of the data latched by the latch 116G at the change timing of the latch pulse LP. An offset value conversion section 140G outputs the G-component offset value based on the G-component higher-order bit data (addition data) corresponding to the present scan line (present line) and the B-component higher-order bit data (addition data) corresponding to the preceding scan line. A latch 130G holds the data latched by the higher-order bit latch 118G at the change timing of the latch pulse LP to hold the higher-order bit data corresponding to the preceding scan line.

The B-component offset value calculation section according to the second configuration example differs from the B-component offset value calculation section according to the first configuration example in that the higher-order bit latch 118B holds the higher-order bit data of the data latched by the latch 116B at the change timing of the latch pulse LP. An offset value conversion section 140B outputs the B-component offset value based on the B-component higher-order bit data (addition data) corresponding to the present scan line (present line). A latch 130B holds the data latched by the higher-order bit latch 118B at the change timing of the latch pulse LP to hold the higher-order bit data corresponding to the preceding scan line.

FIG. 19A is a view illustrative of the operation of the offset value conversion section 140R.

The offset value conversion section 140R shown in FIG. 18 outputs the offset value Roffset corresponding to higher-order bit data $RSUM_n$ of the addition data held by the higher-order bit latch 118R, higher-order bit data $GSUM_{n-1}$ of the G-component addition data corresponding to the preceding scan line held by the latch 130G, and higher-order bit data $BSUM_{n-1}$ of the B-component addition data corresponding to the preceding scan line held by the latch 130B according to a table shown in FIG. 19A. Specifically, when driving the R-component source line, the offset value is superimposed on the R-component grayscale voltage corresponding to the present scan line taking into account the amount of charge stored in the R-component source line, the amount of charge stored in the G-component source line, and the amount of charge stored in the B-component source line when driving the preceding scan line.

For example, the offset value conversion section 140R may calculate the offset value Roffset from the higher-order bit data $RSUM_n$ in the same manner as in the first configuration example, and add up an offset value $GBSUM_{n-1}$ offset corresponding to the higher-order bit data $GSUM_{n-1}$ and $BSUM_{n-1}$ provided in advance and the offset value Roffset.

FIG. 19B is a view illustrative of the operation of the offset value conversion section 140G.

The offset value conversion section 140G shown in FIG. 18 outputs the offset value Goffset corresponding to the higher-order bit data $GSUM_n$ held by the higher-order bit latch 118G and the higher-order bit data $BSUM_{n-1}$ of the B-component addition data corresponding to the preceding scan line held by the latch 130B according to a table shown in FIG. 19B. Specifically, since the R-component grayscale voltage has been supplied when driving the G-component source line, the offset value is superimposed on the G-component grayscale voltage corresponding to the present scan line taking into account the amount of charge stored in the G-component source line and the amount of charge stored in the B-component source line when driving the preceding scan line.

FIG. 19C is a view illustrative of the operation of the offset value conversion section 140B.

The offset value conversion section 140B shown in FIG. 18 outputs the offset value Boffset corresponding to the higher-order bit data $RSUM_n$ of the addition data held by the higher-order bit latch 118B according to a table shown in FIG. 19C. Specifically, since the R-component grayscale voltage and the G-component grayscale voltage have been supplied when driving the B-component source line, the offset value is superimposed on the G-component grayscale voltage corresponding to the present scan line in the same manner as in the first configuration example.

Specifically, the R-component offset value calculation section 28R respectively adds up the first-color-component grayscale data, the second-color-component grayscale data, and the third-color-component grayscale data contained in the grayscale data corresponding to one scan line to calculate the first-color-component addition data, the second-color-component addition data, and the third-color-component addition data, and calculates the first-color-component offset value based on at least the first-color-component addition data corresponding to the present scan line, the second-color-component addition data corresponding to the preceding scan line, and the third-color-component addition data corresponding to the preceding scan line. The grayscale data correction section corrects the first-color-component grayscale data using the first-color-component offset value. The G-component offset value calculation section 28G calculates the second-color-component offset value based on at least the second-color-component addition data corresponding to the present scan line and the third-color-component addition data corresponding to the preceding scan line, and the grayscale data correction section corrects the second-color-component grayscale data using the second-color-component offset value. The B-component offset value calculation section 28B calculates the third-color-component offset value based on at least the third-color-component addition data corresponding to the present scan line, and the grayscale data correction section corrects the third-color-component grayscale data using the third-color-component offset value.

Since the source driver 100 according to the second configuration example having the above-described configuration calculates the offset value corresponding to the amount of charge stored in the parasitic capacitor of the source line immediately before driving the present scan line, the source line $SR_L$ can be quickly stabilized more reliably so that a change in the polarity inversion voltage VCOM can be suppressed as compared with the first configuration example.

1.3.3 Third configuration example

In the first configuration example, the offset value is calculated based on the grayscale data corresponding to one scan line. In a third configuration example, an offset value corresponding to the amount of charge stored in the pixel electrode immediately before the present vertical scan period is calculated. The grayscale data is corrected based on the offset value, and the source line is driven based on the corrected grayscale data.

A source driver according to the third configuration example differs from the source driver 100 according to the first configuration example shown in FIG. 10 as to the R-component offset value calculation section 28R, the G-component offset value calculation section 280, and the B-component offset value calculation section 28B.

Figures 20, 21:
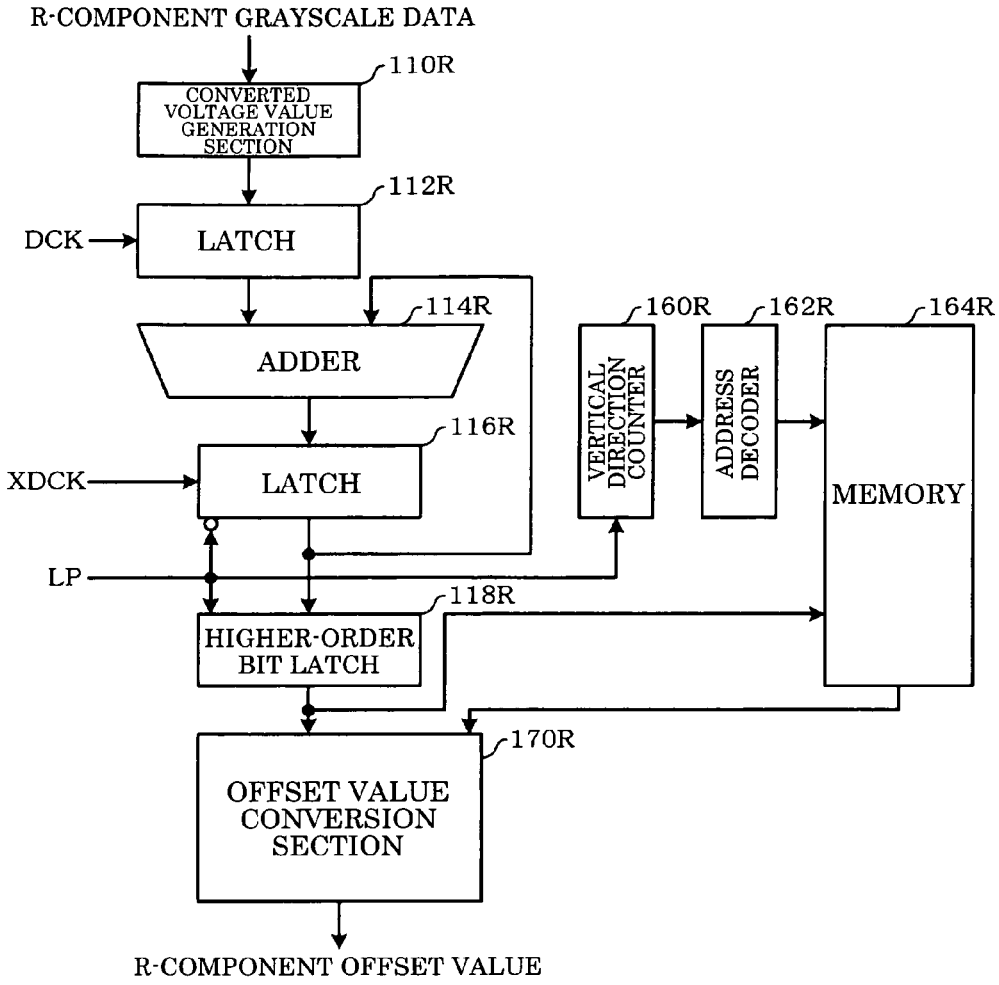
FIG. 20 is a block diagram showing a configuration example of an R-component offset value calculation section of a source driver according to a third configuration example of one embodiment of the invention.
FIG. 21 is a view illustrative of the operation of an offset value conversion section shown in FIG. 20.

FIG. 20 is a block diagram showing a configuration example of the R-component offset value calculation section 28R of the source driver according to the third configuration example. In FIG. 20, the same sections as in FIG. 11 are indicated by the same symbols. Description of these sections is appropriately omitted. The G-component offset value calculation section 28G and the B-component offset value calculation section 28B according to the third configuration example have the same configuration as the R-component offset value calculation section 28R shown in FIG. 20.

The R-component offset value calculation section according to the third configuration example differs from the R-component offset value calculation section according to the first configuration example in that the higher-order bit latch 118R holds the higher-order bit data of the data latched by the latch 116R at the change timing of the latch pulse LP. The R-component offset value calculation section according to the third configuration example includes a vertical direction counter 160R, an address decoder 162R, and a memory 164R. An offset value conversion section 170R outputs the R-component offset value based on the R-component higher-order bit data (addition data) corresponding to the present scan line (present line) and the R-component higher-order bit data (addition data) corresponding to the present scan line in the preceding vertical scan period.

The vertical direction counter 160R calculates the scan line position within one vertical scan period based on the latch pulse LP. The address decoder 162R generates an address of the memory 164R based on the count value of the vertical direction counter 160R. The higher-order bit data held by the higher-order bit latch 118R is written into the memory 164R at a storage location specified by the address generated by the address decoder 162R. The higher-order bit data corresponding to each scan line in the preceding vertical scan period is stored in the memory 164R.

The offset value conversion section 170R calculates the R-component offset value based on the higher-order bit data held by the higher-order bit latch 118R and the higher-order bit data corresponding to the present scan line in the preceding vertical scan period read from the memory 164R.

FIG. 21 is a view illustrative of the operation of the offset value conversion section 170R.

The offset value conversion section 170R shown in FIG. 20 outputs the offset value Roffset corresponding to higher-order bit data $RSUM_p$ of the addition data held by the higher-order bit latch 118R and higher-order bit data $GSUM_{p-1}$ of the R-component addition data corresponding to the present scan line in the preceding vertical scan period read from the memory 164R. Specifically, the offset value is superimposed on the R-component grayscale voltage corresponding to the present scan line taking into account the amount of charge stored in the pixel electrode in the preceding vertical scan period.

Specifically, the R-component offset value calculation section 28R adds up the first-color-component grayscale data contained in the grayscale data corresponding to one scan line to calculate the first-color-component addition data, and outputs the offset value based on the first-color-component addition data corresponding to the present scan line in the present vertical scan period and the first-color-component addition data corresponding to the present scan line in the preceding vertical scan period.

Since the source driver according to the third configuration example having the above-described configuration calculates the offset value corresponding to the amount of charge stored in the pixel electrode immediately before the present vertical scan period, the source line $SR_L$ can be quickly stabilized more reliably so that a change in the polarity inversion voltage VCOM can be suppressed as compared with the first configuration example.

Note that the memory 164R according to the third configuration example may be combined with the second configuration example, and the offset value corresponding to the amount of charge stored in the parasitic capacitor of the source line immediately before driving the present scan line combined with the amount of charge stored in the pixel electrode immediately before the present vertical scan period.

2. Modification 2.1 First Modification

In this embodiment, when the polarity inversion voltage VCOM cannot be recovered in time, a voltage VCOML0 lower in potential than the low-potential-side voltage VCOML may be output as the polarity inversion voltage VCOM in a period corresponding to the offset value, and the polarity inversion voltage VCOM may be returned to the low-potential-side voltage VCOML, for example. Likewise, a voltage VCOMH0 higher in potential than the high-potential-side voltage VCOMH may be output as the polarity inversion voltage VCOM in a period corresponding to the offset value, and the polarity inversion voltage VCOM may be returned to the high-potential-side voltage VCOMH.

Figure 22:
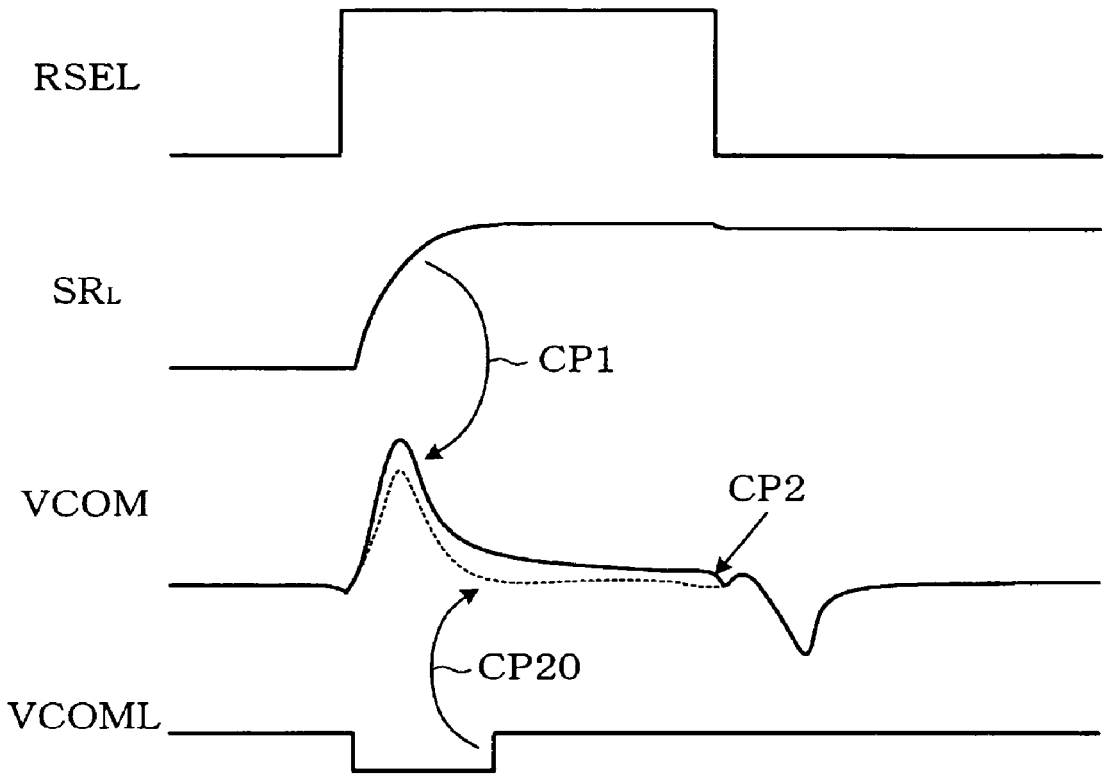
FIG. 22 is a view illustrative of the operation of a liquid crystal display device according to a first modification of one embodiment of the invention.

FIG. 22 is a view illustrative of the operation of a liquid crystal display device according to a first modification of this embodiment. In FIG. 22, the same sections as in FIG. 8 are indicated by the same symbols. Description of these sections is appropriately omitted.

FIG. 22 shows an example in which the voltage VCOML0 is output instead of the low-potential-side voltage VCOML. In the first modification, when the potential of the source line $SR_L$ increases, the potential of the electrode to which the polarity inversion voltage VCOM is applied and which is capacitively coupled with the source line $SR_L$ also increases (CP1). The original potential of the polarity inversion voltage VCOM is recovered through the switching elements $SWH_K$ and $SWL_K$ of the switch circuit.

In order to further stabilize the potential of the polarity inversion voltage VCOM as compared with the above embodiment, the voltage VCOML0 provided in advance is output as the polarity inversion voltage VCOM instead of the low-potential-side voltage VCOML in a period corresponding to the offset value calculated as described above. The low-potential-side voltage VCOML is output as the polarity inversion voltage VCOM after the above period has expired. For example, the polarity inversion voltage generation circuit 68 shown in FIG. 4 may generate the voltages VCOMH0 and VCOML0 in addition to the high-potential-side voltage VCOMH and the low-potential-side voltage VCOML, and the voltage may be changed corresponding to the above period.

Specifically, a source driver 680 may change the voltage level (signal level) of at least one of the high-potential-side voltage VCOMH and the low-potential-side voltage VCOML supplied to one end of the storage capacitor in synchronization with the polarity inversion timing based on the offset value. More specifically, the source driver 680 changes the voltage level of at least one of the high-potential-side voltage VCOMH and the low-potential-side voltage VCOML supplied to one end of the storage capacitor in synchronization with the polarity inversion timing in a period corresponding to the offset value. In this case, period data corresponding to the offset value may be provided in advance in a table, and the period data may be output based on the offset value calculated as described as an index.

According to the first modification, charging or discharging occurs more quickly due to an increase in potential difference, whereby the polarity inversion voltage VCOM can be stabilized quickly.

2.2 Second Modification

In this embodiment, the display panel 12 separates the grayscale voltages multiplexed by time division. Note that the invention is not limited thereto.

Figure 23:
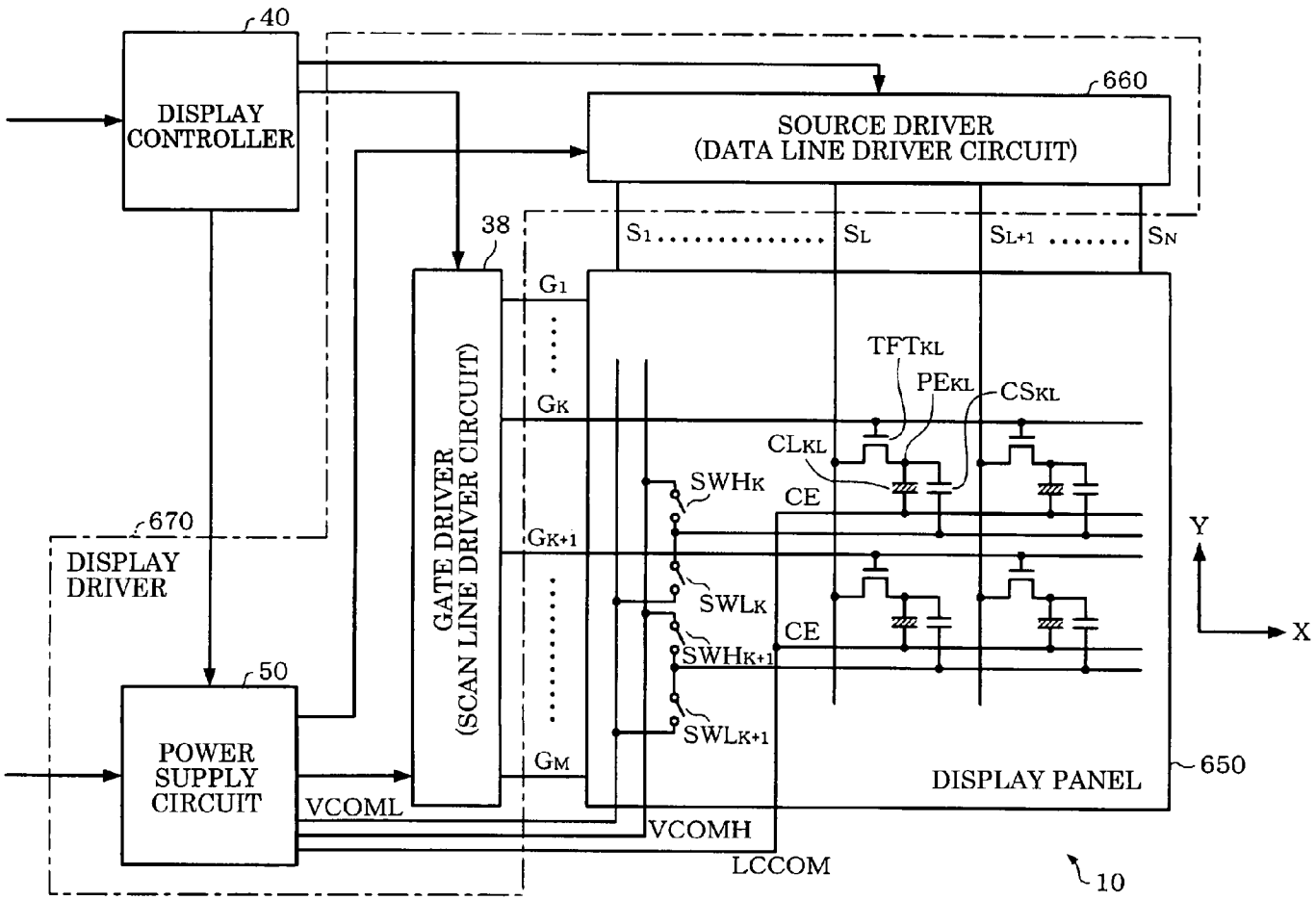
FIG. 23 is a view schematically showing the configuration of a liquid crystal display device according to a second modification of one embodiment of the invention.

FIG. 23 schematically shows the configuration of a liquid crystal display device according to a second modification of this embodiment. In FIG. 23, the same sections as in FIG. 1 are indicated by the same symbols. Description of these sections is appropriately omitted.

In FIG. 23, the liquid crystal display device 10 includes a display panel 650 instead of the display panel 12, and includes a source driver 660 instead of the source driver 20. The display panel 650 includes a plurality of gate lines, a plurality of source lines, and a plurality of pixel electrodes specified by the gate lines and the source lines. In this case, an active matrix type liquid crystal device may be formed by connecting a thin film transistor (TFT) to the source line and connecting the pixel electrode to the TFT.

Specifically, the display panel 650 is an amorphous silicon liquid crystal panel in which an amorphous silicon thin film is formed on an active matrix substrate (e.g. glass substrate). Gate lines $G_1$ to $G_M$ (M is a positive integer equal to or larger than two), arranged in a direction Y in FIG. 23 and extending in a direction X, and source lines $S_1$ to $S_N$ (N is a positive integer equal to or larger than two), arranged in the direction X and extending in the direction Y, are disposed on the active matrix substrate. A thin film transistor $TFT_{KL}$ (switching element in a broad sense) is provided at a position corresponding to the intersection of the gate line $G_K$ ($1 \leqq K \leqq M$, K is a natural number) and the source line $S_L$ ($1 \leqq L \leqq N$, L is a natural number).

A thin film transistor $TFT_{KL}$ (switching element in a broad sense) is provided at a position corresponding to the intersection of the gate line $G_K$ ($1 \leqq K \leqq M$, K is a natural number) and the source line $S_L$ ($1 \leqq L \leqq N$, L is a natural number).

The source driver 660 drives the source lines $S_1$ to $S_N$ of the display panel 650 based on grayscale data. A gate driver 38 scans (sequentially drives) the gate lines $G_1$ to $G_M$ of the display panel 650.

A display driver 670 may include the source driver 660, the gate driver 38, and a power supply circuit 50.

Figure 24:
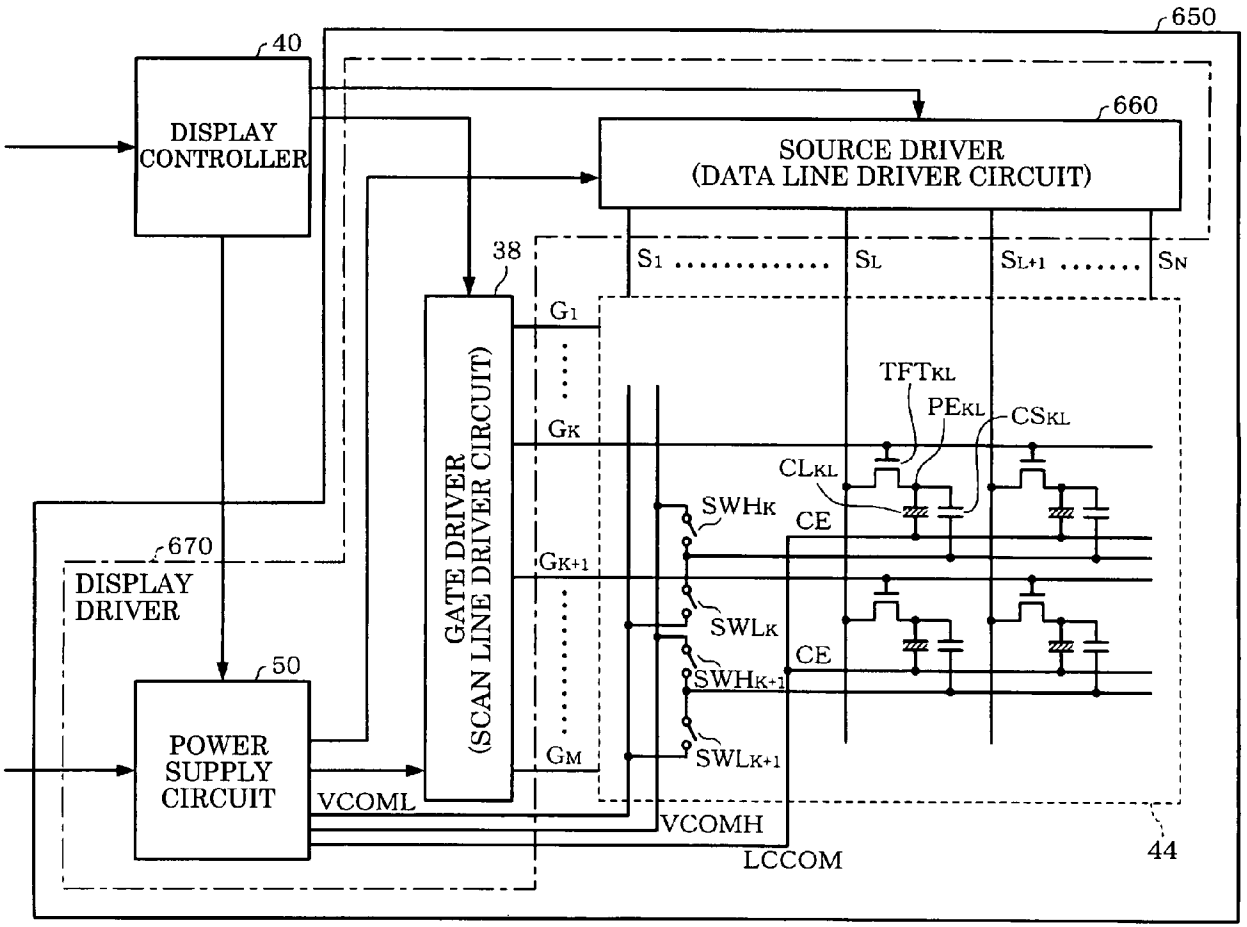
FIG. 24 is a block diagram showing another configuration example of the liquid crystal display device shown in FIG. 23.

FIG. 24 is a block diagram showing another configuration example of the liquid crystal display device shown in FIG. 23. In FIG. 24, the same sections as in FIG. 23 are indicated by the same symbols. Description of these sections is appropriately omitted.

In FIG. 24, the display driver 670 which includes the source driver 660, the gate driver 38, and the power supply circuit 50 is formed on the display panel 650 (panel substrate). Specifically, the display panel 650 may be configured to include a plurality of gate lines, a plurality of source lines, a plurality of pixels (pixel electrodes), each of which is connected to the corresponding gate line and the corresponding source line, a source driver which drives the source lines, and a gate driver which scans the gate lines. A plurality of pixels are formed in a pixel formation region 44 of the display panel 650. Each pixel may include a TFT, of which the source is connected to the source line and the gate is connected to the gate line, and a pixel electrode connected to the drain of the TFT.

In FIG. 24, at least one of the gate driver 38 and the power supply circuit 50 may be omitted from the display panel 650.

Figure 25:
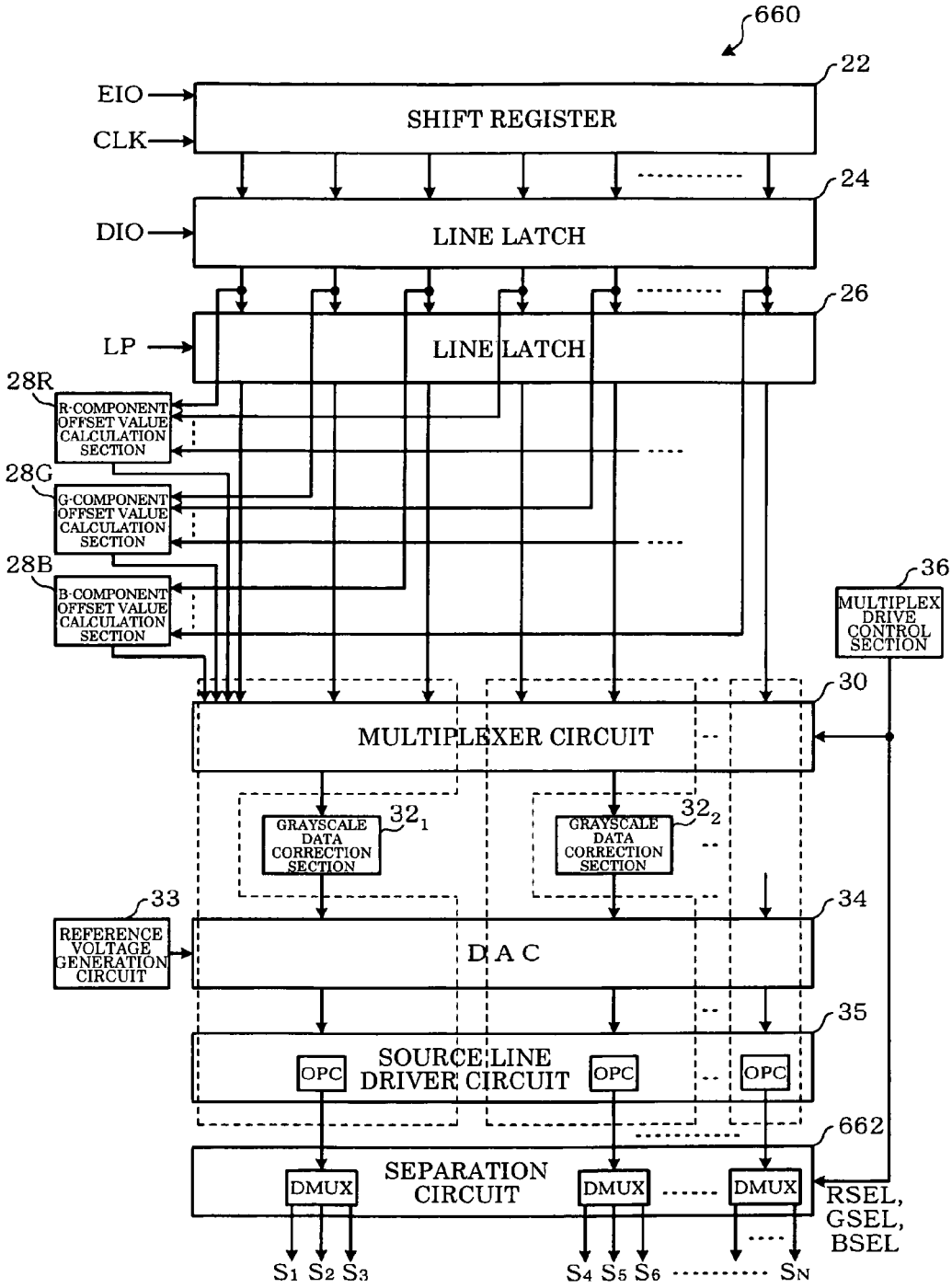
FIG. 25 is a block diagram showing a configuration example of a source driver shown in FIG. 23 or 24.

FIG. 25 is a block diagram showing a configuration example of the source driver 660 shown in FIG. 23 or 24. In FIG. 25, the same sections as in FIG. 10 are indicated by the same symbols. Description of these sections is appropriately omitted.

The source driver 660 shown in FIG. 25 differs from the source driver 100 shown in FIG. 10 in that a separation circuit 662 is provided on the output side of the source line driver circuit 35. The separation circuit 662 includes a plurality of demultiplexers which are respectively provided corresponding to the operational amplifiers of the source line driver circuit 35. Each demultiplexer of the separation circuit 662 has the same function as each demultiplexer of the display panel 12 shown in FIG. 1 or 2. Therefore, each demultiplexer of the separation circuit 662 separates the grayscale voltages multiplexed by time division which are supplied from the corresponding operational amplifier based on the multiplex control signals RSEL, GSEL, and BSEL supplied from the multiplex drive control section 36.

The effects obtained by driving the source lines using the liquid crystal display device 10 and the source driver 20 can also be achieved when driving the source lines using the liquid crystal display device 10 including the display panel 650 and the source driver 660 shown in FIGS. 23 to 25. In FIGS. 23 to 25, a less expensive amorphous silicon liquid crystal panel can be used. Moreover, the circuit scale of the source driver 660 can be significantly reduced.

2.3 Third Modification

The above embodiment has been described taking a liquid crystal display device which performs multiplex drive as an example. Note that the invention may also be applied to a liquid crystal display device which performs normal drive.

Figure 26:
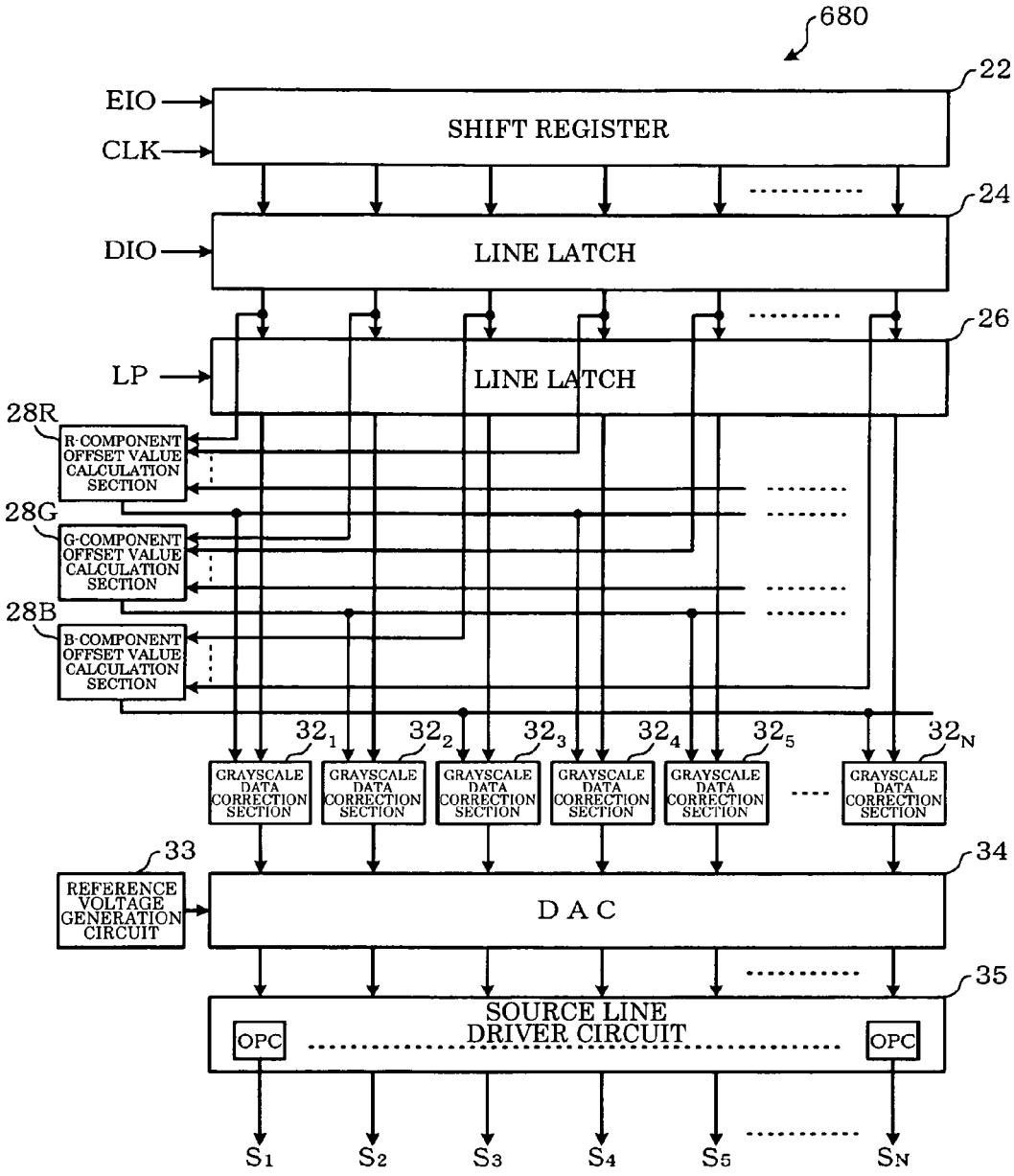
FIG. 26 is a block diagram showing a configuration example of a source driver according to a third modification of one embodiment of the invention.

FIG. 26 is a block diagram showing a configuration example of a source driver according to a third modification of this embodiment. In FIG. 26, the same sections as in FIG. 10 are indicated by the same symbols. Description of these sections is appropriately omitted.

A source driver 680 shown in FIG. 26 can drive the source lines of the display panel 650 shown in FIG. 23 or 24. The source driver 680 shown in FIG. 26 differs from the source driver 20 shown in FIG. 10 in that the multiplexer circuit 30 and the multiplex drive control section 36 are omitted.

According to the third modification, the above-described effects can be achieved when normally driving a liquid crystal display device.

3. Electronic Instrument

An electronic instrument to which the above-described liquid crystal display device (e.g., source driver and power supply circuit) is applied is described below.

3.1 Projection-Type Display Device

A projection-type display device is one type of electronic instrument which is formed using the above-described liquid crystal display device.

Figure 27:
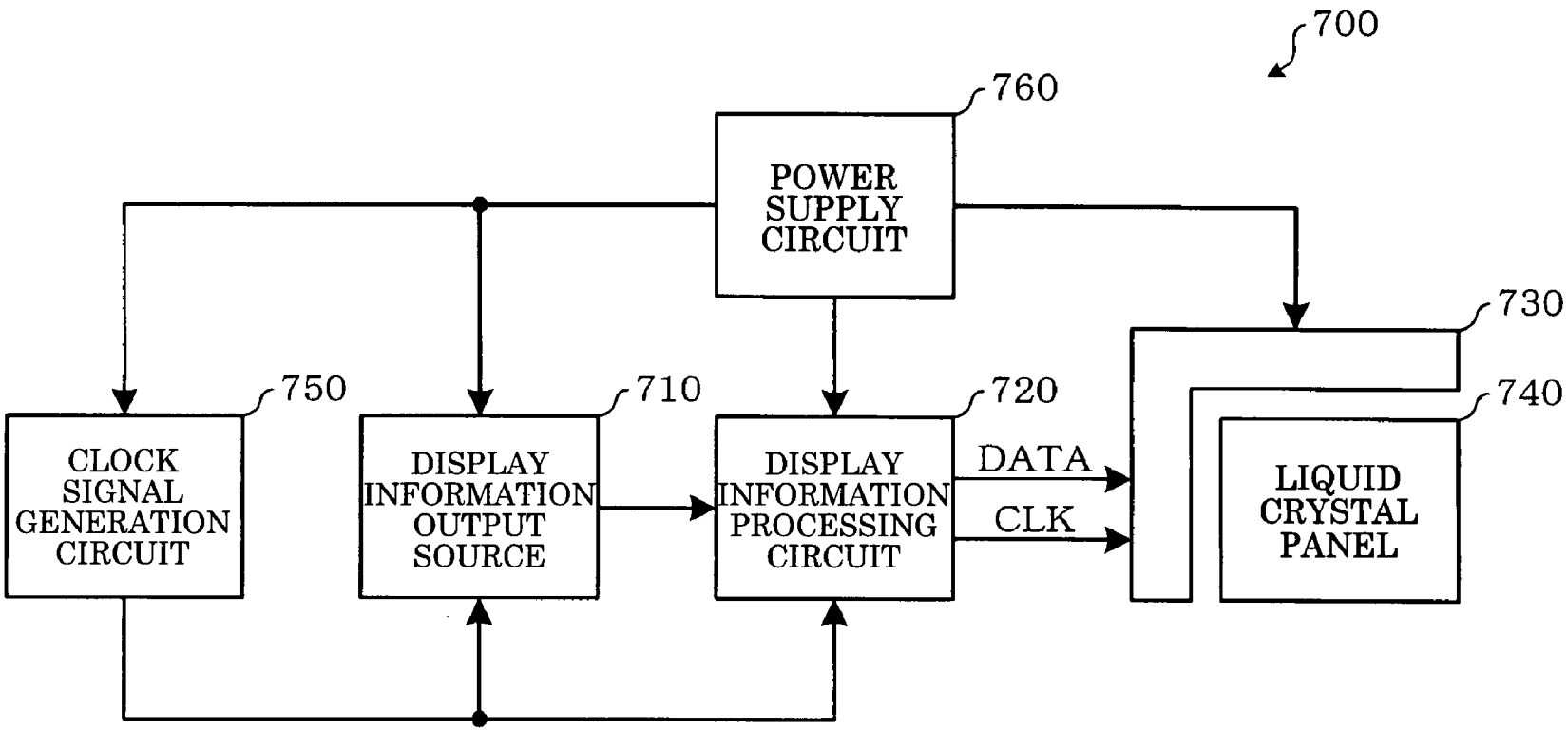
FIG. 27 is a block diagram showing a configuration example of a projection-type display device to which a liquid crystal device according to one embodiment of the invention is applied.

FIG. 27 is a block diagram showing a configuration example of a projection-type display device to which the liquid crystal display device according to the above embodiment is applied.

A projection-type display device 700 includes a display information output source 710, a display information processing circuit 720, a display driver circuit 730 (display driver), a liquid crystal panel 740 (display panel in a broad sense), a clock signal generation circuit 750, and a power supply circuit 760. The display information output source 710 includes a memory such as a read only memory (ROM), a random access memory (RAM), or an optical disk device, and a tuning circuit which tunes and outputs an image signal. The display information output source 710 outputs display information (e.g., image signal in a given format) to the display information processing circuit 720 based on a clock signal from the clock signal generation circuit 750. The display information processing circuit 720 may include an amplification/polarity inversion circuit, a phase expansion circuit, a rotation circuit, a gamma correction circuit, a clamping circuit, and the like. The display driver circuit 730 includes a gate driver and a source driver. The display driver circuit 730 drives the liquid crystal panel 740. The power supply circuit 760 supplies power to each circuit.

Figure 28:
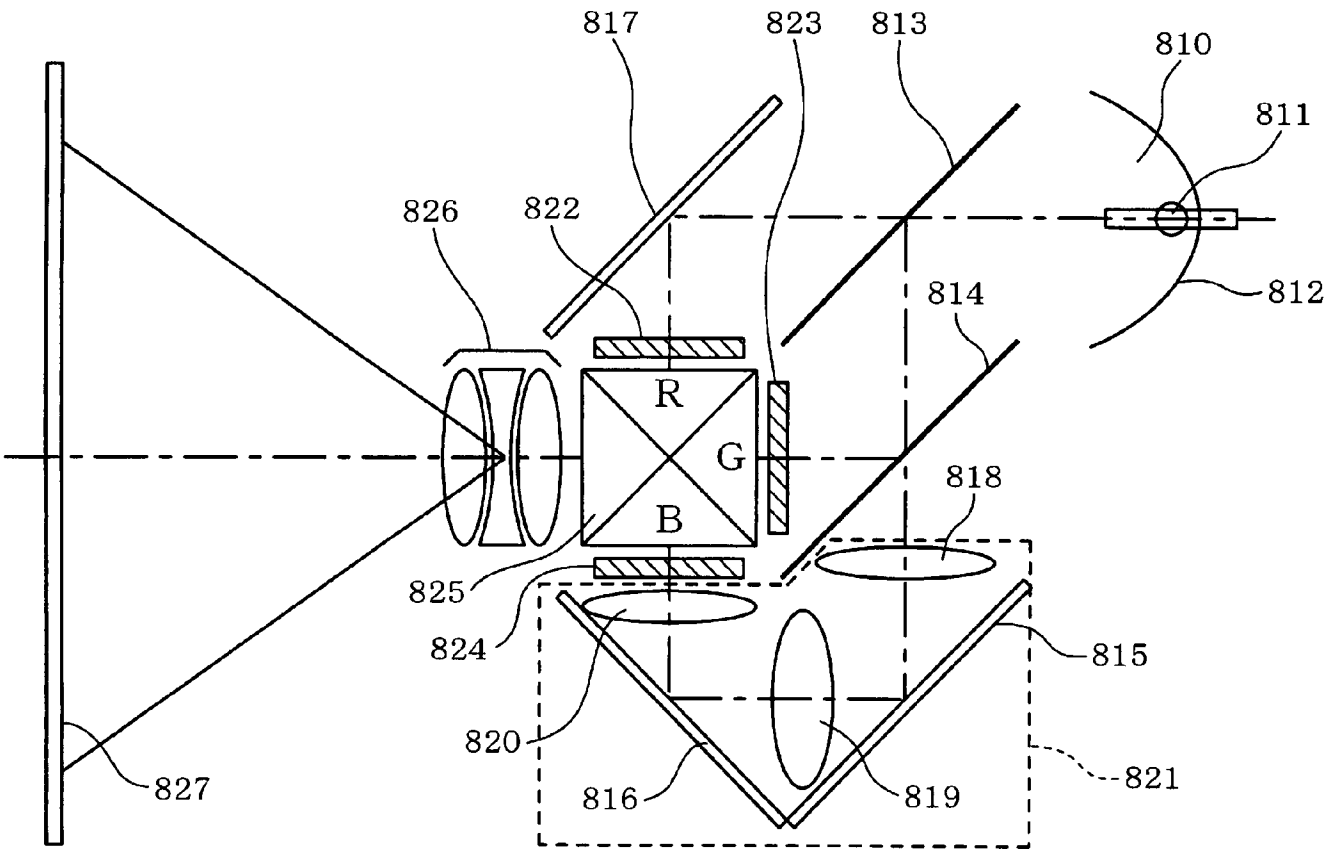
FIG. 28 is a schematic view showing the main portion of a projection-type display device.

FIG. 28 is a schematic view showing the main portion of the projection-type display device.

The projection-type display device includes a light source 810, dichroic mirrors 813 and 814, reflection mirrors 815, 816, and 817, an incident lens 818, a relay lens 819, an exit lens 820, liquid crystal light modulators 822, 823, and 824, a cross dichroic prism 825, and a projection lens 826. The light source 810 includes a lamp 811 (e.g., metal halide lamp), and a reflector 812 which reflects light emitted from the lamp. The dichroic mirror 813 which reflects blue/green light allows red light contained in a beam from the light source 810 to pass through, and reflects blue light and green light. Red light which has passed through the dichroic mirror 813 is reflected by the reflection mirror 817, and enters the red light liquid crystal light modulator 822. Green light reflected by the dichroic mirror 813 is reflected by the dichroic mirror 814 which reflects green light, and enters the green light liquid crystal light modulator 823. Blue light also passes through the second dichroic mirror 814. A photo-conductive means 821 formed of a relay lens system including the incident lens 818, the relay lens 819, and the exit lens 820 is provided for blue light in order to prevent optical loss due to a long optical path. Blue light enters the blue light liquid crystal light modulator 824 through the photo-conductive means 821. The three color light rays modulated by each light modulator circuit enter the cross dichroic prism 825. Four rectangular prisms are bonded in the cross dichroic prism 825, and a dielectric multilayer film which reflects red light and a dielectric multilayer film which reflects blue light are formed on the inner side in the shape of a cross. The three color light rays are synthesized by the dielectric multilayer films so that light which expresses a color image is formed. The projection means of the projection-type display device is formed as described above. Light synthesized by the projection means is projected onto a screen 827 by a projection lens 826 (projection optical system) so that an enlarged image is displayed.

3.2 Portable Telephone

A portable telephone is another type of electronic instrument which is formed using the above-described liquid crystal display device.

Figure 29:
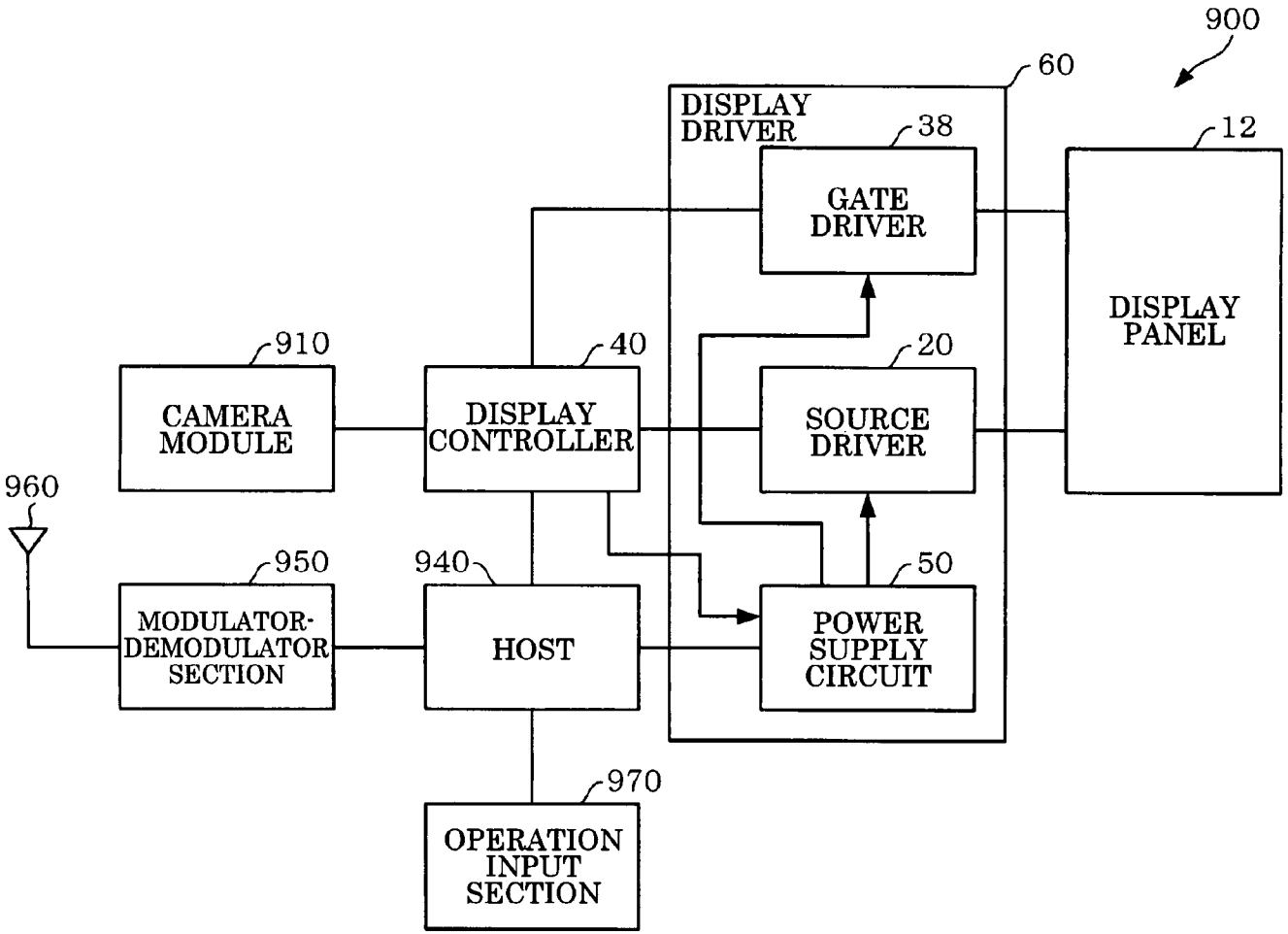
FIG. 29 is a block diagram showing a configuration example of a portable telephone to which a liquid crystal display device according to one embodiment of the invention is applied.

FIG. 29 is a block diagram showing a configuration example of a portable telephone to which the liquid crystal display device according to the above embodiment is applied. In FIG. 29, the same sections as in FIG. 1, 2, 23, or 24 are indicated by the same symbols. Description of these sections is appropriately omitted.

A portable telephone 900 includes a camera module 910. The camera module 910 includes a CCD camera, and supplies image data obtained by the CCD camera to a display controller 40 in a YUV format.

The portable telephone 900 includes the display panel 12 (or display panel 650; hereinafter the same). The display panel 12 is driven by the source driver 20 (or source driver 660 or 680; hereinafter the same) and the gate driver 38. The display panel 12 includes a plurality of gate lines, a plurality of source lines, and a plurality of pixels.

The display controller 40 is connected to the source driver 20 and the gate driver 38, and supplies grayscale data in an RGB format to the source driver 20.

The power supply circuit 50 is connected to the source driver 20 and the gate driver 38, and supplies drive power supply voltages to the source driver 20 and the gate driver 38. The power supply circuit 50 supplies the constant voltage and the polarity inversion voltage VCOM to the display panel 12.

A host 940 is connected to the display controller 40. The host 940 controls the display controller 40. The host 940 demodulates grayscale data received via an antenna 960 using a modulator-demodulator section 950, and supplies the demodulated grayscale data to the display controller 40. The display controller 40 causes the source driver 20 and the gate driver 38 to display an image on the display panel 12 based on the grayscale data.

The host 940 modulates grayscale data generated by the camera module 910 using the modulator-demodulator section 950, and directs transmission of the modulated data to another communication device via the antenna 960.

The host 940 transmits and receives grayscale data, captures an image using the camera module 910, and displays an image on the display panel 12 based on operation information from an operation input section 970.

In FIG. 29, the host 940 or the display controller 40 may be referred to as a means that supplies the grayscale data.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. For example, the invention may be applied not only to drive the liquid crystal display panel, but also to drive an electroluminescence display device, a plasma display device, and the like. The invention may be applied to a drive method other than the above-described scan line inversion drive. The invention is not limited to the polarity inversion drive method.

Some of the requirements of any claim of the invention may be omitted from a dependent claim which depends on that claim. Some of the requirements of any independent claim of the invention may be allowed to depend on any other independent claim.

What is claimed is:

1. A source driver that supplies a grayscale voltage to a liquid crystal capacitor and a storage capacitor provided in parallel with the liquid crystal capacitor, a voltage that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section, and the offset value calculation section adding up first-color-component grayscale data contained in grayscale data corresponding to one scan line to calculate first-color-component addition data, and outputting an offset value corresponding to the first-color-component addition data.

2. The source driver as defined in claim 1, the offset value calculation section including a converted voltage value generation section that generates voltage value data corresponding to the grayscale data, the offset value calculation section calculating the offset value corresponding to the respective color components of one pixel based on the voltage value data instead of the grayscale data.

3. The source driver as defined in claim 1, the grayscale data correction section correcting the grayscale data by adding up the offset value and the grayscale data.

4. The source driver as defined in claim 1, the source driver changing a voltage level of at least one of a high-potential-side voltage and a low-potential-side voltage supplied to the one end of the storage capacitor in synchronization with the polarity inversion timing based on the offset value.

5. The source driver as defined in claim 1, the source driver changing a voltage level of at least one of a high-potential-side voltage and a low-potential-side voltage supplied to the one end of the storage capacitor in synchronization with the polarity inversion timing in a period corresponding to the offset value.

6. An electro-optical device comprising:

a plurality of gate lines;

a plurality of source lines;

a plurality of liquid crystal capacitors;

a plurality of storage capacitors;

a plurality of switching elements, when a switching element among the plurality of switching elements has been selected by a corresponding gate line among the plurality of gate lines, a voltage of a corresponding source line among the plurality of source lines being supplied to one end of a corresponding liquid crystal capacitor among the plurality of liquid crystal capacitors and one end of a corresponding storage capacitor among the plurality of storage capacitors;

a gate driver that scans the plurality of gate lines; and the source driver as defined in claim 1 that drives the plurality of source lines, a high-potential-side voltage or a low-potential-side voltage being applied to the other end of the plurality of storage capacitors in synchronization with a polarity inversion timing.

7. An electronic instrument comprising the electro-optical device as defined in claim 6.

8. An electronic instrument comprising the source driver as defined in claim 1.

9. A source driver that supplies a grayscale voltage to a liquid crystal capacitor and a storage capacitor provided in parallel with the liquid crystal capacitor, a voltage that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section, when the source line driver section drives the source line by time division within one horizontal scan period in an order of a first color component, a second color component, and a third color component, the offset value calculation section respectively adding up first-color-component grayscale data, second-color-component grayscale data, and third-color-component grayscale data contained in grayscale data corresponding to one scan line to calculate first-color-component addition data, second-color-component addition data, and third-color-component addition data, and calculating a first-color-component offset value based on at least the first-color-component addition data corresponding to a present scan line, the second-color-component addition data corresponding to a preceding scan line, and the third-color-component addition data corresponding to the preceding scan line;

the grayscale data correction section correcting the first-color-component grayscale data using the first-color-component offset value; and the source line driver section driving the source line based on the first-color-component grayscale data that has been corrected by the grayscale data correction section.

10. The source driver as defined in claim 9, the offset value calculation section calculating a second-color-component offset value based on at least the second-color-component addition data corresponding to the present scan line and the third-color-component addition data corresponding to the preceding scan line;

the grayscale data correction section correcting the second-color-component grayscale data using the second-color-component offset value; and the source line driver section driving the source line based on the second-color-component grayscale data that has been corrected by the grayscale data correction section.

11. The source driver as defined in claim 9, the offset value calculation section calculating a third-color-component offset value based on at least the third-color-component addition data corresponding to the present scan line;

the grayscale data correction section correcting the third-color-component grayscale data using the third-color-component offset value; and the source line driver section driving the source line based on the third-color-component grayscale data that has been corrected by the grayscale data correction section.

12. An electronic instrument comprising the source driver as defined in claim 9.

13. A source driver that supplies a grayscale voltage to a liquid crystal capacitor and a storage capacitor provided in parallel with the liquid crystal capacitor, a voltage that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section, and the offset value calculation section adding up first-color-component grayscale data contained in grayscale data corresponding to one scan line to calculate first-color-component addition data, and outputting the offset value based on the first-color-component addition data corresponding to a present scan line in a present vertical scan period and the first-color-component addition data corresponding to the present scan line in a preceding vertical scan period.

14. An electronic instrument comprising the source driver as defined in claim 13.

15. A source driver that supplies a grayscale signal to an element capacitor and a storage capacitor provided in parallel with the element capacitor, a signal that changes in synchronization with a polarity inversion timing being applied to one end of the storage capacitor, the source driver comprising:

an offset value calculation section that calculates an offset value based on grayscale data corresponding to respective color components of one pixel;

a grayscale data correction section that corrects the grayscale data using the offset value corresponding to the respective color components; and a source line driver section that drives a source line corresponding to the respective color components based on the grayscale data that has been corrected by the grayscale data correction section, the source line driver section driving the source line corresponding to the respective color components based on the grayscale data that has been corrected by the grayscale data correction section, and then driving the source line corresponding to the respective color components based on the grayscale data before being corrected by the grayscale data correction section, and the offset value calculation section adding up first-color-component grayscale data contained in grayscale data corresponding to one scan line to calculate first-color-component addition data, and outputting an offset value corresponding to the first-color-component addition data.

16. An electro-optical device comprising:

a plurality of gate lines;

a plurality of source lines;

a plurality of liquid crystal capacitors;

a plurality of storage capacitors;

a plurality of switching elements, when a switching element among the plurality of switching elements has been selected by a corresponding gate line among the plurality of gate lines, a voltage of a corresponding source line among the plurality of source lines being supplied to one end of a corresponding liquid crystal capacitor among the plurality of liquid crystal capacitors and one end of a corresponding storage capacitor among the plurality of storage capacitors;

a gate driver that scans the plurality of gate lines; and the source driver as defined in claim 15 that drives the plurality of source lines, a high-potential-side voltage or a low-potential-side voltage being applied to the other end of the plurality of storage capacitors in synchronization with a polarity inversion timing.

17. An electronic instrument comprising the electro-optical device as defined in claim 16.

18. An electronic instrument comprising the source driver as defined in claim 15.

* * * * *